US007530653B2

(12) United States Patent
Hirayama

(10) Patent No.: US 7,530,653 B2
(45) Date of Patent: May 12, 2009

(54) RECORDING HEAD AND RECORDER COMPRISING SUCH RECORDING HEAD

(75) Inventor: Nobuyuki Hirayama, Fujisawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 283 days.

(21) Appl. No.: 11/134,418

(22) Filed: May 23, 2005

(65) Prior Publication Data

US 2005/0206685 A1 Sep. 22, 2005

Related U.S. Application Data

(63) Continuation of application No. PCT/JP03/15273, filed on Nov. 28, 2003.

(30) Foreign Application Priority Data

Nov. 29, 2002 (JP) ..... 2002-348725

(51) Int. Cl.
*B41J 29/38* (2006.01)

(52) U.S. Cl. ..... 347/9; 347/12

(58) Field of Classification Search ..... 347/9, 347/12

See application file for complete search history.

(56) References Cited

U.S. PATENT DOCUMENTS

| | | | | |
|---|---|---|---|---|
| 4,967,192 | A | 10/1990 | Hirane et al. | 345/211 |
| 5,163,760 | A | 11/1992 | Nardozzi | 400/120 |
| 5,627,732 | A | 5/1997 | Loh et al. | |
| 5,671,002 | A | 9/1997 | Murano | 347/237 |
| 5,886,713 | A | 3/1999 | Okada et al. | 347/14 |
| 5,933,161 | A | 8/1999 | Sato et al. | 347/12 |
| 5,952,884 | A | 9/1999 | Ide | 330/288 |
| 6,371,588 | B1 | 4/2002 | Tsuruoka | 347/12 |
| 6,400,349 | B1 | 6/2002 | Nagumo | |
| 6,523,922 | B2 | 2/2003 | Hirayama | |
| 2003/0038617 | A1 | 2/2003 | Yaklin | 323/304 |
| 2005/0140707 | A1 | 6/2005 | Imanaka et al. | |
| 2005/0206685 | A1 | 9/2005 | Hirayama | |
| 2005/0212857 | A1 | 9/2005 | Hirayama | |
| 2005/0264608 | A1 | 12/2005 | Hirayama | |

(Continued)

FOREIGN PATENT DOCUMENTS

EP 0 684 537 A1 11/1995

(Continued)

OTHER PUBLICATIONS

Patent Abstracts of Japan, vol. 2000, No. 24, published May 11, 2001, English Abstract of Japanese Document No. 2001-191531 published Jul. 17, 2001.

(Continued)

*Primary Examiner*—Julian D Huffman
(74) *Attorney, Agent, or Firm*—Fitzpatrick, Cella, Harper & Scinto

(57) ABSTRACT

A recording head having a plurality of recording elements comprises a plurality of switching elements, each provided in correspondence to each of the plurality of recording elements, constant current sources, each provided in correspondence to each of groups in which the plurality of recording elements are divided, for flowing a constant current into a plurality of recording elements of each group, and a constant current control circuit for controlling the constant current supplied from the constant current sources, and the recording elements are driven by the constant current.

20 Claims, 18 Drawing Sheets

U.S. PATENT DOCUMENTS

| | | | |
|---|---|---|---|
| 2005/0264613 | A1 | 12/2005 | Hirayama |
| 2006/0284909 | A1 | 12/2006 | Kasai et al. |

FOREIGN PATENT DOCUMENTS

| | | | |
|---|---|---|---|
| EP | 1 164 013 | A1 | 12/2001 |
| JP | 3-208656 | | 9/1991 |
| JP | 5-31938 | | 2/1993 |
| JP | 5-270052 | | 10/1993 |
| JP | 5-330119 | | 12/1993 |
| JP | 8-51322 | | 2/1996 |
| JP | 2871779 | B2 | 1/1999 |
| JP | 11-42809 | | 2/1999 |
| JP | 11-234060 | | 8/1999 |
| JP | 11-291550 | A | 10/1999 |
| JP | 2000-246900 | | 9/2000 |
| JP | 2001-1513 | A | 1/2001 |
| JP | 2001-191531 | | 7/2001 |
| JP | 2003-58264 | | 2/2003 |

OTHER PUBLICATIONS

English-language translation of Japanese Office Action dated May 15, 2006 issued in Japanese Patent Application No. 2002-348724 (corresponding to U.S. Appl. No. 11/134,416).

English-language translation of Korean Office Action issued Sep. 15, 2006 in corresponding Korean patent application No. 2005-7009612.

English-language translation of Japanese Office Action issued Sep. 25, 2006 in related Japanese patent application No. 2002-348724.

English-language translation of Japanese Office Action issued Sep. 25, 2006 in corresponding Japanese patent application No. 2002-348725.

Korean Office Action issued Sep. 15, 2006 in related Korean patent application No. 2005-7009613 and English translation.

RECORDING HEAD AND RECORDER COMPRISING SUCH RECORDING HEAD

This application is a continuation application of pending International Application No. PCT/JP2003-015273, filed on Nov. 28, 2003.

TECHNICAL FIELD

The present invention relates to a recording head having a plurality of recording elements and a recording apparatus having the recording head.

BACKGROUND ART

There has conventionally been known an inkjet head which causes a heater arranged in the nozzle of a printhead to generate thermal energy, bubbles ink near the heater by using thermal energy, and discharges ink from the nozzle to print. FIG. 11 shows an example of a heater driving circuit in the inkjet head.

To print at a high speed, heaters are desirably concurrently driven as many as possible to simultaneously discharge ink from many nozzles. However, the electric power supply capacity of the electric power supply of a printer apparatus is limited, and a current value which can be supplied at once is limited by, e.g., a voltage drop caused by the resistance of a wiring line extending from the power supply to the heater. For this reason, time divisional driving of driving a plurality of heaters in time division to discharge ink is generally adopted. In time divisional driving, for example, a plurality of heaters are divided into a plurality of blocks (groups) each formed from adjacent heaters, and driving is so time-divided as not to concurrently drive two or more heaters in each block. This can suppress a total current flowing through heaters and eliminate the need to supply large electric power at once. The operation of the driving circuit which executes this heater driving will be explained with reference to FIG. 11.

NMOS transistors $\mathbf{1102}_{11}$ to $\mathbf{1102}_{mx}$ corresponding to respective heaters $\mathbf{1101}_{11}$ to $\mathbf{1101}_{mx}$ are divided into blocks 1 to m which contain the same number of (x) NMOS transistors, as shown in FIG. 11. More specifically, in block 1, a power supply line from a power supply pad 1104 (+) is commonly connected to the heaters $\mathbf{1101}_{11}$ to $\mathbf{1101}_{1x}$, and the NMOS transistors $\mathbf{1102}_{11}$ to $\mathbf{1102}_{1x}$ are series-connected to the corresponding heaters $\mathbf{1101}_{11}$ to $\mathbf{1101}_{1x}$ between the power supply pad 1104 (+) and ground 1104 (−). When a control signal is supplied from a control circuit 1105 to the gates of the NMOS transistors $\mathbf{1102}_{11}$ to $\mathbf{1102}_{1x}$, the NMOS transistors $\mathbf{1102}_{11}$ to $\mathbf{1102}_{1x}$ are turned on to supply a current from the power supply line through corresponding heaters and heat the heaters $\mathbf{1101}_{11}$ to $\mathbf{110}_{1x}$.

FIG. 12 is a timing chart showing a timing at which a current is sent to drive heaters in each block of the heater driving circuit shown in FIG. 11.

For example, when block 1 in FIG. 11 is exemplified, control signals VG1 to VGx are timing signals for driving the first to xth heaters $\mathbf{1101}_{11}$ to $\mathbf{1101}_{1x}$ belonging to block 1. More specifically, VG1 to VGx represent the waveforms of signals input to the control terminals (gates) of the NMOS transistors $\mathbf{1102}_{11}$ to $\mathbf{1102}_{1x}$ of block 1. A corresponding NMOS transistor 1102 is turned on for a high-level control signal, and a corresponding NMOS transistor is turned off for a low-level control signal. This also applies to the remaining blocks 2 to m. In FIG. 12, Ih1 to Ihx represent current values flowing through the heaters $\mathbf{1101}_{11}$ to $\mathbf{1101}_{1x}$.

In this manner, heaters in each block are sequentially driven in time division by sending a current. The number of heaters driven in each block by sending a current can always be controlled to one or less, and no large current need be supplied to a heater.

FIG. 13 depicts a view showing an example of the layout of a heater substrate (substrate which constitutes the printhead) on which the heater driving circuit in FIG. 11 is formed. FIG. 13 shows the layout of power supply lines connected from the power supply pads 1104 (+) and (−) to blocks 1 to m shown in FIG. 11.

Power supply lines $\mathbf{1301}_1$ to $\mathbf{1301}_m$ are individually connected from the power supply pad 1104 (+) to respective blocks 1 to m, and power supply lines $\mathbf{1302}_1$ to $\mathbf{1302}_m$ are connected from the power supply pad 1104 (+). As described above, by keeping the maximum number of heaters concurrently driven in each block to one or less, a current value flowing through a wiring line divided for each block can always be suppressed to be equal to or smaller than a current flowing through one heater. Even when a plurality of heaters in different blocks are concurrently driven, voltage drop amounts on wiring lines on the heater substrate can be made uniform. At the same time, even when a plurality of heaters are concurrently driven, the amounts of energy applied to respective heaters can be made almost uniform.

Recently, printers require higher speeds and higher precision, and the printhead of the printer integrates a larger number of nozzles at a higher density. In heater driving of the printhead, heaters are required to be simultaneously driven as many as possible at a high speed in terms of the printing speed.

A heater substrate is prepared by forming many heaters and their driving circuit on the same semiconductor substrate. The number of heater substrates formed from one wafer must be increased to reduce the cost, and downsizing of the heater substrate is also demanded.

When, however, the number of concurrently driven heaters is increased, as described above, the heater substrate requires wiring lines corresponding to the number of concurrently driven heaters. As the number of wiring lines increases, the wiring region per wiring line decreases to increase the wiring resistance when the area of the heater substrate is limited. Further, as the number of wiring lines increases, each wiring width decreases, and variations in resistance between wiring lines on the heater substrate increase. This problem occurs also when the heater substrate is downsized, and the wiring resistance and variations in resistance increase. Since heaters and power supply lines are series-connected to the power supply on the heater substrate, as described above, increases in wiring resistance and resistance variations lead to a high regulation of a voltage applied to each heater.

When energy applied to a heater is too small, ink discharge becomes unstable; when the energy is too large, the heater durability degrades. To print with high quality, energy applied to a heater is desirably constant. However, large fluctuations in voltage applied to a heater degrade the heater durability and make ink discharge unstable, as described above.

Since a wiring line outside the heater substrate is common to a plurality of heaters, the voltage drop on the common wiring line changes depending on the number of concurrently driven heaters. In order to make energy applied to each heater constant against variations in voltage drop, energy applied to each heater is adjusted by the voltage application time. However, as the number of concurrently driven heaters increases, the voltage drop becomes larger on the common wiring line. The voltage application time in heater driving becomes longer, making it difficult to drive a heater at a high speed.

Japanese Patent Laid-Open No. 2001-191531 proposes a method which solves such problems caused by variations in energy applied to a heater. FIG. 14 is a circuit diagram showing a heater driving circuit disclosed in Japanese Patent Laid-Open No. 2001-191531. In this arrangement, printing elements (R1 to Rn) are driven by a constant current using constant current sources (Tr14 to Tr(n+13)) and switching elements (Q1 to Qn) which are arranged for the respective printing elements (R1 to Rn). In this case, constant current sources equal in number to printing elements are necessary, the area of the heater substrate becomes much larger than that in a conventional driving method, and the cost of the heater substrate becomes higher. In order to stabilize energy applied to a heater, output currents from a plurality of constant current sources must be uniform. However, as the number of constant current sources increases, output currents from these constant current sources vary much more. It is difficult to reduce variations in output current between a plurality of constant current sources particularly on a heater substrate having a larger number of heaters for higher speed and higher precision of printing by the printer.

DISCLOSURE OF INVENTION

The present invention has been made in consideration of the prior art, and has as its feature to provide a recording head which can stably record at a high speed even if the number of concurrently driven recording elements increases, and a recording apparatus having the recording head.

It is another feature of the present invention to provide a recording head which drives recording elements by a constant current and can adjust the constant current value to apply uniform energy to the recording elements, and a recording apparatus having the recording head.

Other features and advantages of the present invention will be apparent from the following description taken in conjunction with the accompanying drawings.

BRIEF DESCRIPTION OF DRAWINGS

The accompanying drawings, which are incorporated in and constitute a part of the specification, illustrate embodiments of the invention and, together with the description, serve to explain the principles of the invention.

BEST MODE FOR CARRYING OUT THE INVENTION

Preferred embodiments of the present invention will be described in detail below with reference to the accompanying drawings.

The following "heater substrate" means not only a base of a silicon semiconductor but also a substrate having elements, wiring lines, and the like.

"On a heater substrate" means not only "on a heater substrate", but also "on the surface of a heater substrate" and "inside a heater substrate near the surface". "Built-in" according to the embodiments means not "to arrange separate elements on a substrate", but "to integrally form or manufacture elements on a heater substrate by a semiconductor circuit manufacturing process or the like".

First Embodiment

Figure 1:
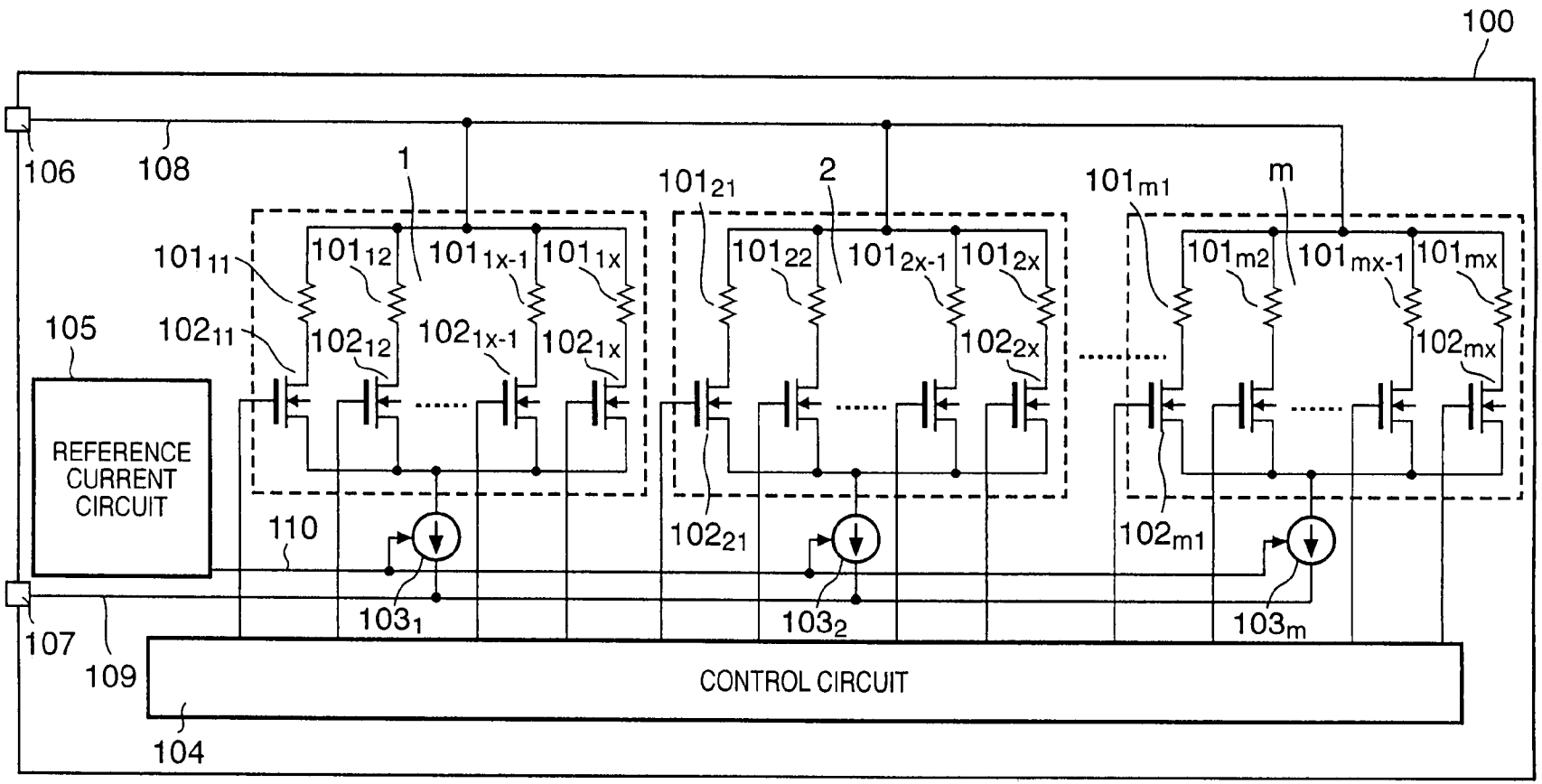
FIG. 1 is a circuit diagram showing an example of a heater driving circuit in a printhead according to the first embodiment of the present invention.

FIG. 1 is a circuit diagram for explaining the arrangement of a heater driving circuit mounted on the heater substrate of an inkjet printhead according to the first embodiment of the present invention.

In FIG. 1, reference numerals $\mathbf{101}_{11}$ to $\mathbf{101}_{mx}$ denote heaters (heater resistors) for printing. A current flows to each heater to generate heat, and a corresponding nozzle discharges an ink droplet. The heaters $\mathbf{101}_{11}$ to $\mathbf{101}_{mx}$ are divided into blocks (groups) 1 to m, and each block includes x heaters, and x NMOS transistors which are arranged in correspondence with the respective heaters. Reference numerals $\mathbf{102}_{11}$ to $\mathbf{102}_{mx}$ denote NMOS transistors for ON/OFF-controlling energization to corresponding heaters. Reference numerals $\mathbf{103}_1$ to $\mathbf{103}_m$ denote constant current sources which are arranged for the respective blocks. Reference numeral 104 denotes a control circuit which controls ON/OFF operation of each NMOS transistor 102 in accordance with printing data to be printed. Reference numeral 105 denotes a reference current circuit which outputs a control signal 110 to the constant current sources $\mathbf{103}_1$ to $\mathbf{103}_m$ to control constant current values generated by the respective constant current sources. Reference numerals 106 and 107 denote electric power supply pads which are connected to an electric power supply (not shown) outside the substrate, and heater driving power is supplied via these power supply pads. Reference numerals 108 and 109 denote electric power supply lines which supply heater driving power from the power supply pads 106 and 107 to blocks 1 to m.

In block 1, for example, the NMOS transistors $\mathbf{102}_{11}$ to $\mathbf{102}_{1x}$ are series-connected to corresponding heaters $\mathbf{101}_{11}$ to $\mathbf{101}_{1x}$, and control supply/stop of a current to the series-connected heaters. More specifically, the sources of the NMOS transistors $\mathbf{102}_{11}$ to $\mathbf{102}_{1x}$ are connected to the heaters $\mathbf{101}_{11}$ to $\mathbf{101}_{1x}$, and the drains of the NMOS transistors $\mathbf{102}_{11}$ to $\mathbf{102}_{1x}$ are commonly connected to the constant current source $\mathbf{103}_1$. The terminals of the heaters $\mathbf{101}_{11}$ to $\mathbf{101}_{1x}$ on one side are also commonly connected to the power supply line 108. The NMOS transistors $\mathbf{102}_{11}$ to $\mathbf{102}_{1x}$ function as the first driving switches for the heaters $\mathbf{101}_{11}$ to $\mathbf{101}_{1x}$, and the constant current source 103, functions as the second driving switch for the heaters $\mathbf{101}_{11}$ to $\mathbf{101}_{1x}$. This arrangement also applies to the remaining blocks 2 to m. That is, also in blocks 2 and m, reference numerals $\mathbf{101}_{21}$ to $\mathbf{101}_{2x}$ and $\mathbf{101}_{ml}$ to $\mathbf{101}_{mx}$ denote heaters; and $\mathbf{102}_{21}$ to $102_{2x}$ and $102_{m1}$ to $102_{mx}$, NMOS transistors.

The respective constant current sources $\mathbf{103}_1$ to $\mathbf{103}_m$ are series-connected to the NMOS transistors $\mathbf{102}_{11}$ to $\mathbf{102}_{mx}$ and heaters $\mathbf{101}_{11}$ to $\mathbf{101}_{mx}$. The respective constant current sources $\mathbf{103}_1$ to $\mathbf{103}_m$ output constant currents to the terminals of the constant current sources 103, and the magnitude of the output current value is adjusted by the control signal 110 from the reference current circuit 105.

The control circuit 104 outputs signals corresponding to image signals (printing signals) to be printed to the gates of the NMOS transistors $\mathbf{102}_{11}$ to $\mathbf{102}_{mx}$, and controls switching of the MOS transistors $\mathbf{102}_{11}$ to $\mathbf{102}_{mx}$.

[Operation of Heater Driving Circuit]

Figure 2:
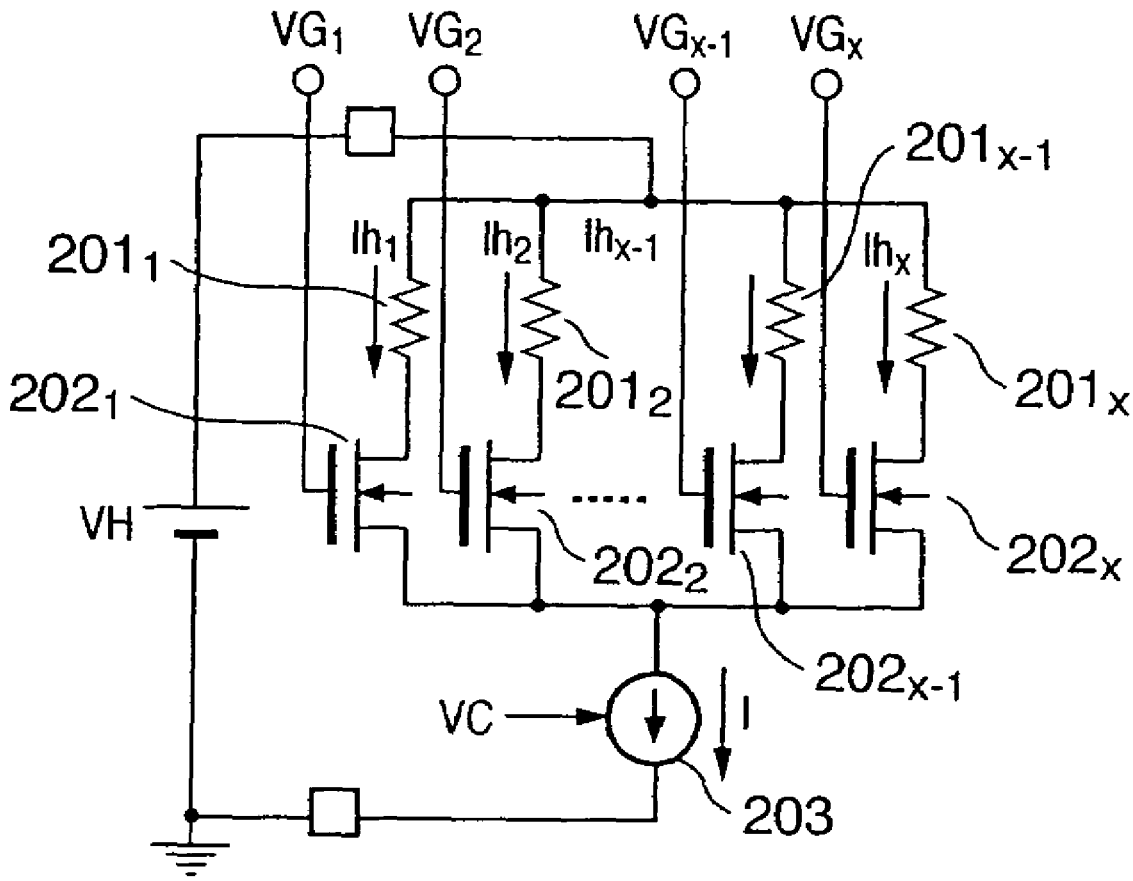
FIG. 2 is an equivalent circuit diagram showing the driving circuit according to the first embodiment of the present invention.
Figure 3:
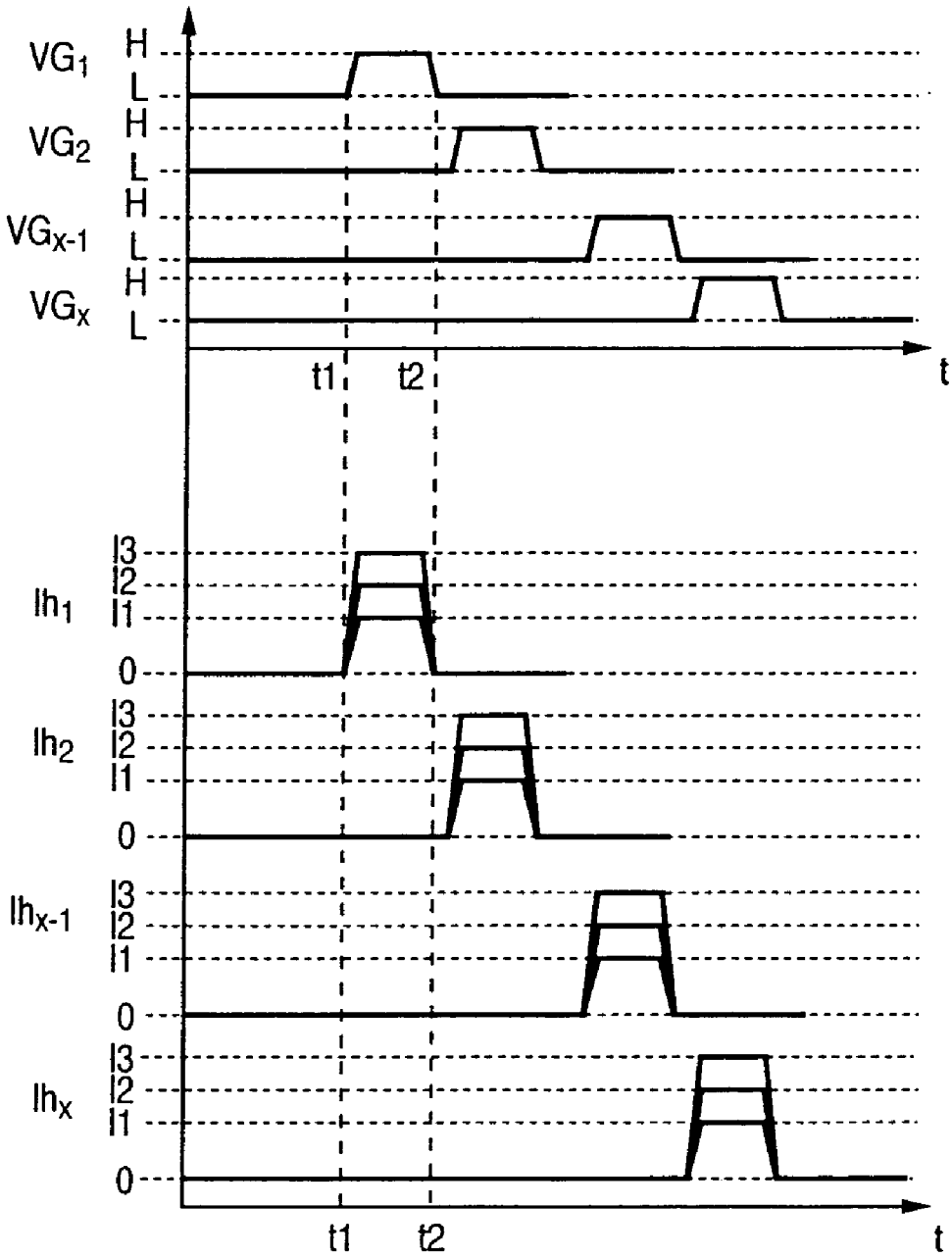
FIG. 3 is a timing chart for explaining the operation timing of the circuit in FIG. 2.

FIG. 2 is a circuit diagram showing the equivalent circuit of one block containing x heaters, x NMOS transistors, and one constant current source. FIG. 3 is a timing chart for explaining a driving signal and a current flowing through each heater.

In FIG. 2, signals VG1 to VGx are printing signals of one block corresponding to image signals supplied from the control circuit 104 of FIG. 1. The arrangement of the control circuit 104 may be a circuit (shift register, latch, or the like) which controls an image signal. A signal VC is a control signal supplied from the reference current circuit 105 to a constant current source 203, and corresponds to the control signal 110 of FIG. 1. A current value generated by the constant current source 203 (corresponding to the constant current sources $\mathbf{103}_1$ to $\mathbf{103}_m$ in FIG. 1) is controlled in accordance with the control signal VC.

For descriptive convenience, NMOS transistors $\mathbf{202}_1$ to $\mathbf{202}_x$ are assumed to ideally operate as 2-terminal switches each having the drain and source. The MMOS transistors $\mathbf{202}_1$ to $\mathbf{202}_x$ are turned on (drains and sources are short-circuited) when the signal level of the signal VG (VG1 to VGx) is high level, and off (drains and sources are open-circuited) at low level. The constant current source 203 is assumed to supply a constant current I set by the control signal VC between the terminals (in FIG. 2 from top to down) when a given voltage is applied between them.

FIG. 3 is a timing chart showing the output timing chart of the signal VG (VG1 to VGx) and the waveform of a current flowing through each heater at that time.

When the heater $\mathbf{201}_1$ shown in FIG. 2 is exemplified, the signal VG1 is at low level during the period up to time t1. The NMOS transistor $\mathbf{202}_1$ is OFF, the output of the constant current source 203 and the heater $\mathbf{201}_1$ are disconnected, and no current flows through the heater $\mathbf{201}_1$. During the period from time t1 to time t2, the signal VG1 changes to high level. In response to this, the gate voltage of the NMOS transistor $\mathbf{202}_1$ in FIG. 2 changes to high level, the source and drain are short-circuited, and a constant current I output from the constant current source 203 flows through the heater $\mathbf{201}_1$. During the period from time t1 to time t2, a current is supplied to the heater $\mathbf{201}_1$ to generate heat, and ink near the heater $\mathbf{201}_1$ is heated, bubbles, and is discharged from a nozzle corresponding to the heater $\mathbf{201}_1$, printing a pixel (dot).

After time t2, the signal VG1 changes to low level again, and no current flows through the heater $\mathbf{201}_1$. Similarly, energization and driving of the heaters $\mathbf{201}_2$ to $\mathbf{201}_x$ are performed in synchronism with the signals VG2 to VGx.

The supply times of a current to the respective heaters, i.e., the heater driving times are controlled by the signals VG1 to VGx, and the magnitudes (represented by I1 to I3 in FIG. 3) of the currents Ih1 to Ihx flowing through the respective heaters are controlled by the control signal VC to the constant current source 203.

With the above arrangement, the reference current circuit 105 sets the output current values (I1 to I3) of the constant current source 203, and the set output current flows through the corresponding heaters $\mathbf{201}_1$ to $\mathbf{201}_x$ by the NMOS transistors $\mathbf{202}_1$ to $\mathbf{202}_x$ only for times defined by the signals VG1 to VGx.

In the above description, the sources and drains are ideally short-circuited when the NMOS transistors $\mathbf{202}_1$ to $\mathbf{202}_x$ are ON. In practice, voltage drops occur between the sources and drains when the NMOS transistors $\mathbf{202}_1$ to $\mathbf{202}_x$ are ON. By setting a power supply voltage high enough against the voltage drop, a current output from the constant current source 203 is directly supplied to the heater, and substantially the same operation as the above-described heater driving is executed.

Note that the reference current circuit 105 may be equipped with a DIP switch or the like so as to allow the user to selectively set the control signal 110 of a desired voltage. Alternatively, the reference current circuit 105 may be so configured as to output the control signal 110 of a desired voltage level in accordance with a signal from the controller of a printer apparatus having the printhead.

Second Embodiment

Figure 4:
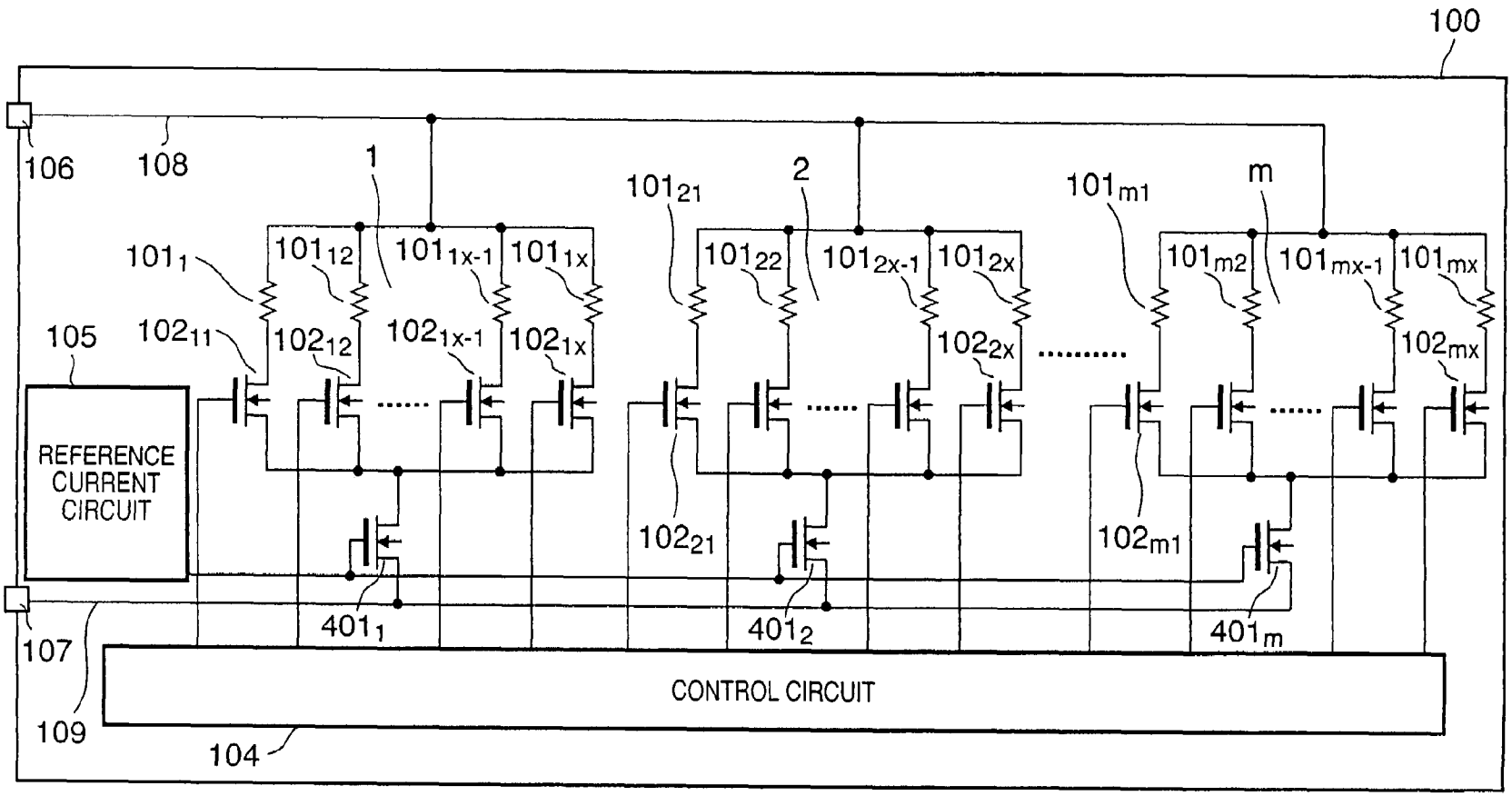
FIG. 4 is a circuit diagram showing an example of a heater driving circuit in a printhead according to the second embodiment of the present invention.

FIG. 4 is a circuit diagram for explaining the arrangement of a head driving circuit in a printhead according to the second embodiment of the present invention. In the second embodiment, the constant current sources $\mathbf{103}_1$ to $\mathbf{103}_m$ in the first embodiment are implemented by NMOS transistors $\mathbf{401}_1$ to $\mathbf{401}_m$.

The drains of the NMOS transistors $\mathbf{401}_1$ to $\mathbf{401}_m$ are respectively connected to the sources of NMOS transistors $\mathbf{102}_{11}$ to $\mathbf{102}_{nx}$. The gates of the NMOS transistors $\mathbf{401}_1$ to $\mathbf{401}_m$ receive a control signal 110 from a reference current circuit 105, and the drains of the NMOS transistors $\mathbf{401}_1$ to $\mathbf{401}_m$ output currents. The output currents are controlled by the gate voltages of the MOS transistors $\mathbf{401}_1$ to $\mathbf{401}_m$ that are connected to the reference current circuit 105.

The operation of the NMOS transistors $\mathbf{401}_1$ to $\mathbf{401}_m$ in FIG. 4 will be explained with reference to FIGS. 5 and 6.

Figure 5:
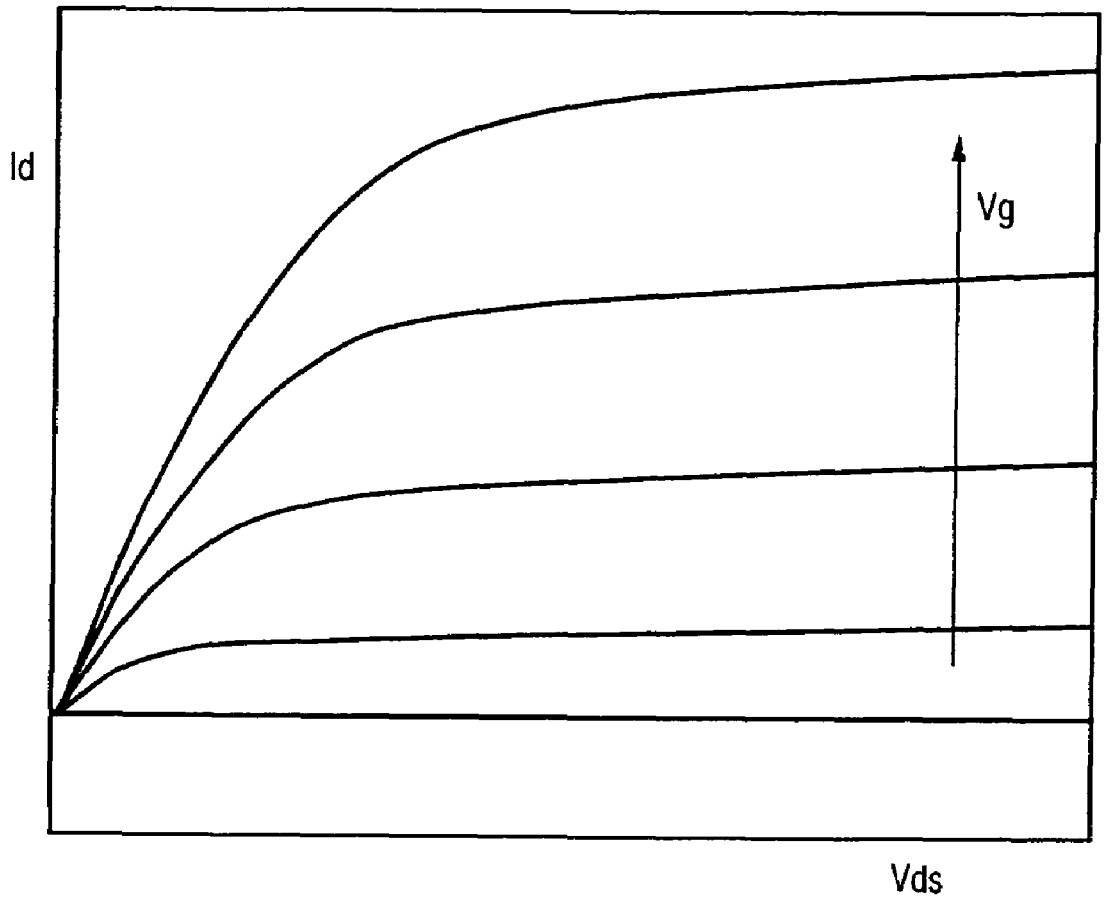
FIG. 5 is a graph showing the characteristic of a MOS transistor used in the second embodiment.
Figure 6:
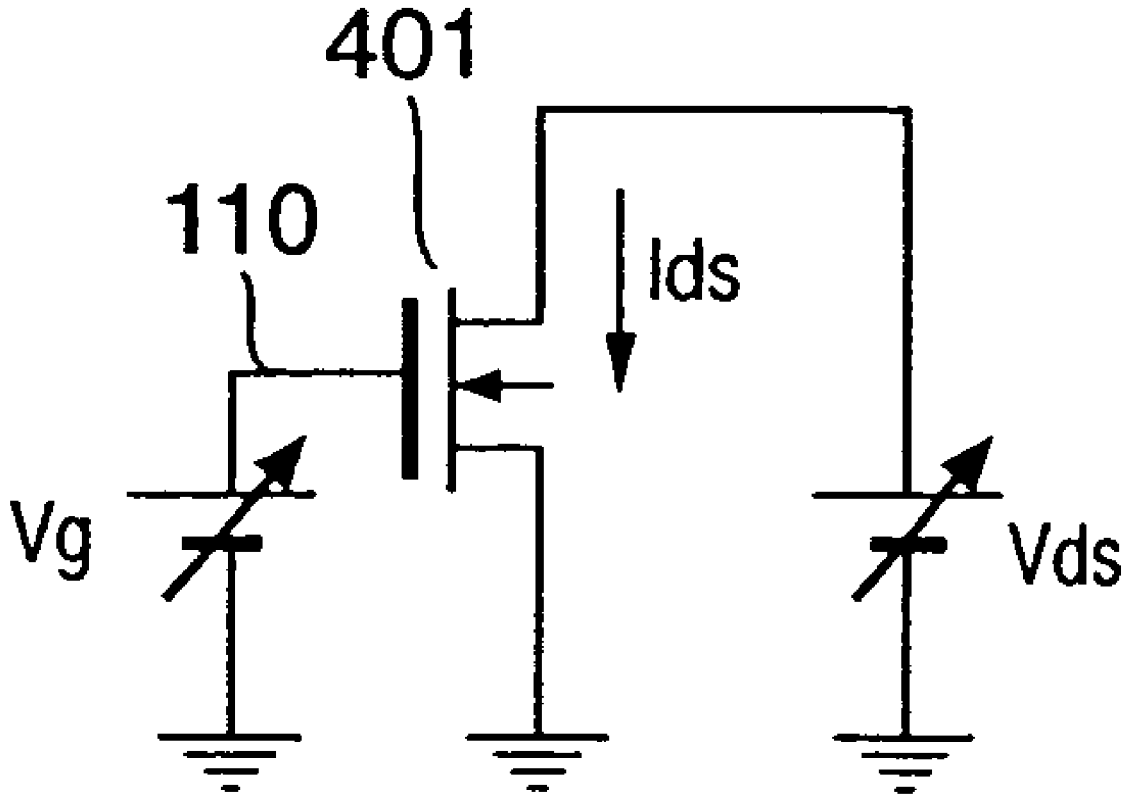
FIG. 6 is a circuit diagram showing the characteristic measurement conditions of the MOS transistor according to the second embodiment of the present invention.

FIG. 5 is a graph showing the general static characteristic of an NMOS transistor used as each of the NMOS transistors $\mathbf{401}_1$ to $\mathbf{401}_m$ in FIG. 4. FIG. 6 is an equivalent circuit diagram for explaining the bias conditions.

FIG. 5 shows the characteristic of a drain current Id when a drain voltage Vds is changed using a gate voltage Vg as a parameter. The voltages Vg and Vds of the NMOS transistors $\mathbf{401}_1$ to $\mathbf{401}_m$ are set so that the NMOS transistors $\mathbf{401}_1$ to $\mathbf{401}_m$ operate in a region (saturation region or the like) where Id hardly changes upon a change in Vds in FIG. 5. This setting can provide an output current which hardly depends on the drain voltages of the NMOS transistors $\mathbf{401}_1$ to $\mathbf{401}_m$. The NMOS transistors $\mathbf{401}_1$ to $\mathbf{401}_m$ can operate as constant current sources for supplying constant currents to corresponding heater blocks.

Since the drain current changes depending on the gate voltage Vg of the NMOS transistors $\mathbf{401}_1$ to $\mathbf{401}_m$, a current value to be supplied to the heaters of each block can be set to a desired value by controlling the gate voltage Vg. This means that the same control as that by the control VC in the first embodiment can be performed. The ON resistance characteristic as the current-to-voltage characteristic between the sources and drains of the NMOS transistors $^{401}{}_1$ to $\mathbf{401}_m$ can be controlled by the gate voltage Vg. By controlling the ON resistance value by the gate voltage Vg, a desired constant current can be supplied to the heater.

Third Embodiment

Figure 7:
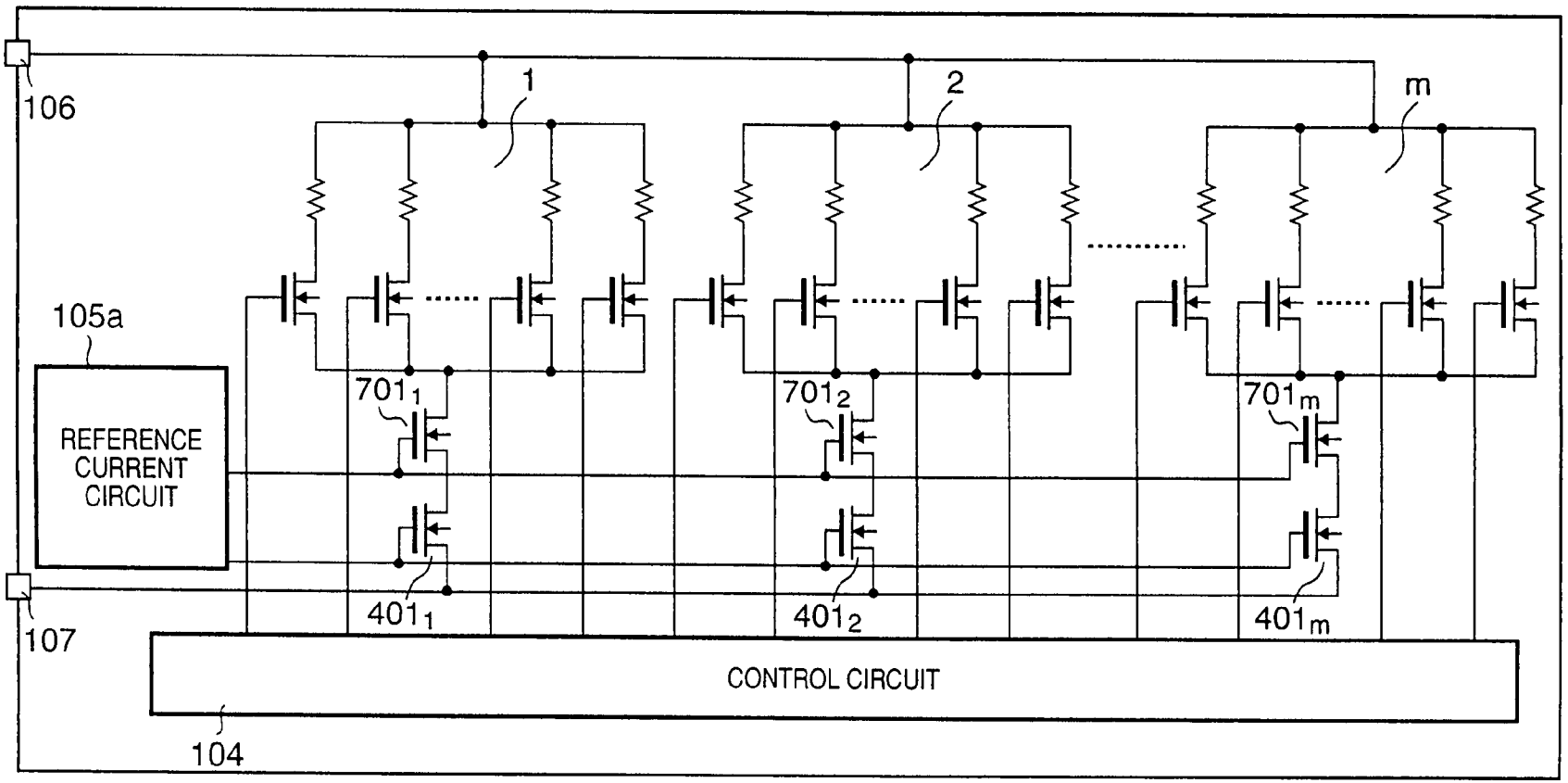
FIG. 7 is a circuit diagram showing an example of a heater driving circuit in a printhead according to the third embodiment of the present invention.

FIG. 7 is a circuit diagram for explaining a head driving circuit in a printhead according to the third embodiment of the present invention. In the third embodiment, the sources of NMOS transistors $\mathbf{701}_1$ to $\mathbf{701}_m$ are connected to the drains of the NMOS transistors $\mathbf{401}_1$ to $\mathbf{401}_m$ in FIG. 4, and two corresponding NMOS transistors are cascade-connected in series to form a constant current source. The gates of the NMOS transistors $\mathbf{701}_1$ to $\mathbf{701}_m$ are also connected to a reference current circuit 105*a*. The third embodiment will explain a structure of two transistors, but the present invention can also be applied to a structure of a larger number of transistors.

The NMOS transistors $\mathbf{701}_1$ to $\mathbf{701}_m$ operate as grounded-gate transistors, and fix the drain voltages of the NMOS transistors $\mathbf{401}_1$ to $401_m$ on the basis of the potentials between the gates and sources of the NMOS transistors $\mathbf{701}_1$ to $\mathbf{701}_m$. The gate voltages of the NMOS transistors $\mathbf{701}_1$ to $\mathbf{701}_m$ are so set as to operate the NMOS transistors $\mathbf{401}_1$ to $\mathbf{401}_m$ in a region (saturation region or the like) where the drain current Id hardly changes upon a change in the drain voltage Vds. By fixing the gate voltages of the NMOS transistors $\mathbf{701}_1$ to $\mathbf{701}_m$, their source voltages can be suppressed to small potential variations between the gates and sources upon variations in the drain voltages of the NMOS transistors $\mathbf{701}_1$ to $\mathbf{701}_m$. Variations in the drain voltages of the NMOS transistors $\mathbf{401}_1$ to $\mathbf{401}_m$ operating as constant current sources can be suppressed smaller than in the circuit of FIG. 4 upon variations in power supply voltage and variations in the ON resistance values and wiring resistance values of MOS transistors.

Fourth Embodiment

Figure 8:
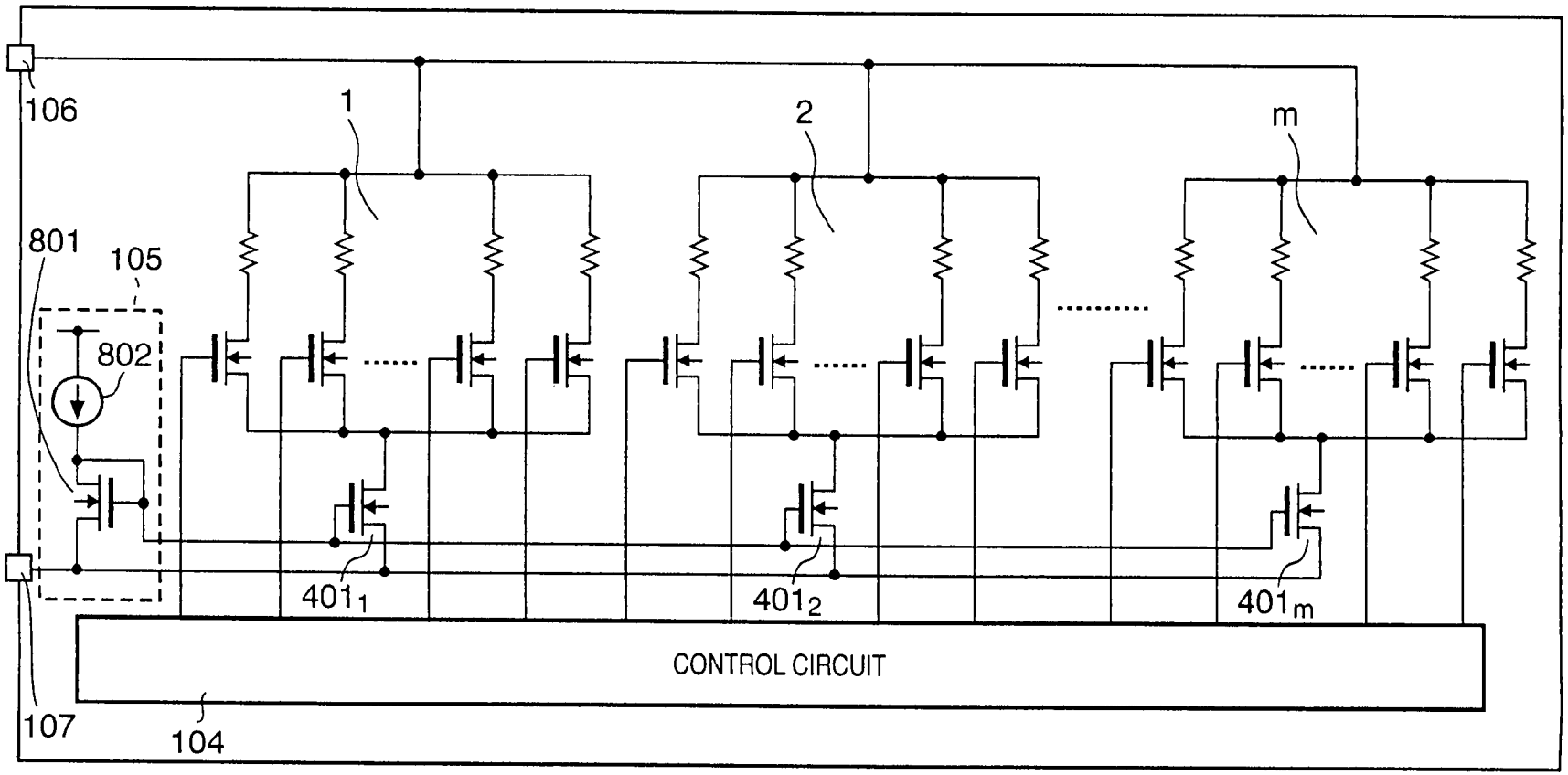
FIG. 8 is a circuit diagram showing an example of a heater driving circuit in a printhead according to the fourth embodiment of the present invention.

FIG. 8 is a circuit diagram showing the arrangement of a head driving circuit according to the fourth embodiment of the present invention. FIG. 8 illustrates an example of the concrete circuit arrangement of a reference current circuit 105 in addition to the circuit arrangement of FIG. 4.

The reference current circuit 105 forms a current mirror circuit which outputs currents from the drains of NMOS transistors $\mathbf{401}_1$ to $\mathbf{401}_m$ by using an NMOS transistor 801 as a reference. The gate and drain of the NMOS transistor 801 are diode-connected, and a reference current source 802 is connected to the node. The gate of the NMOS transistor 801 is commonly connected to the gates of the NMOS transistors $\mathbf{401}_1$ to $\mathbf{401}_m$. When the gate sizes of the NMOS transistor 801 and NMOS transistors $\mathbf{401}_1$ to $401_m$ are equal to each other, the gate voltages of the NMOS transistor 801 and NMOS transistors $\mathbf{401}_1$ to $\mathbf{401}_m$ become equal to each other, and currents equal to a reference current are output from the drains of the NMOS transistors $\mathbf{401}_1$ to $\mathbf{401}_m$. When the gate sizes of the NMOS transistor 801 and NMOS transistors $\mathbf{401}_1$ to $\mathbf{401}_m$ are different from each other, a constant output current which is proportional to the reference current in correspondence with the gate size ratio of the NMOS transistor 801 and NMOS transistors $\mathbf{401}_1$ to $\mathbf{401}_m$ is obtained.

Fifth Embodiment

Figure 9:
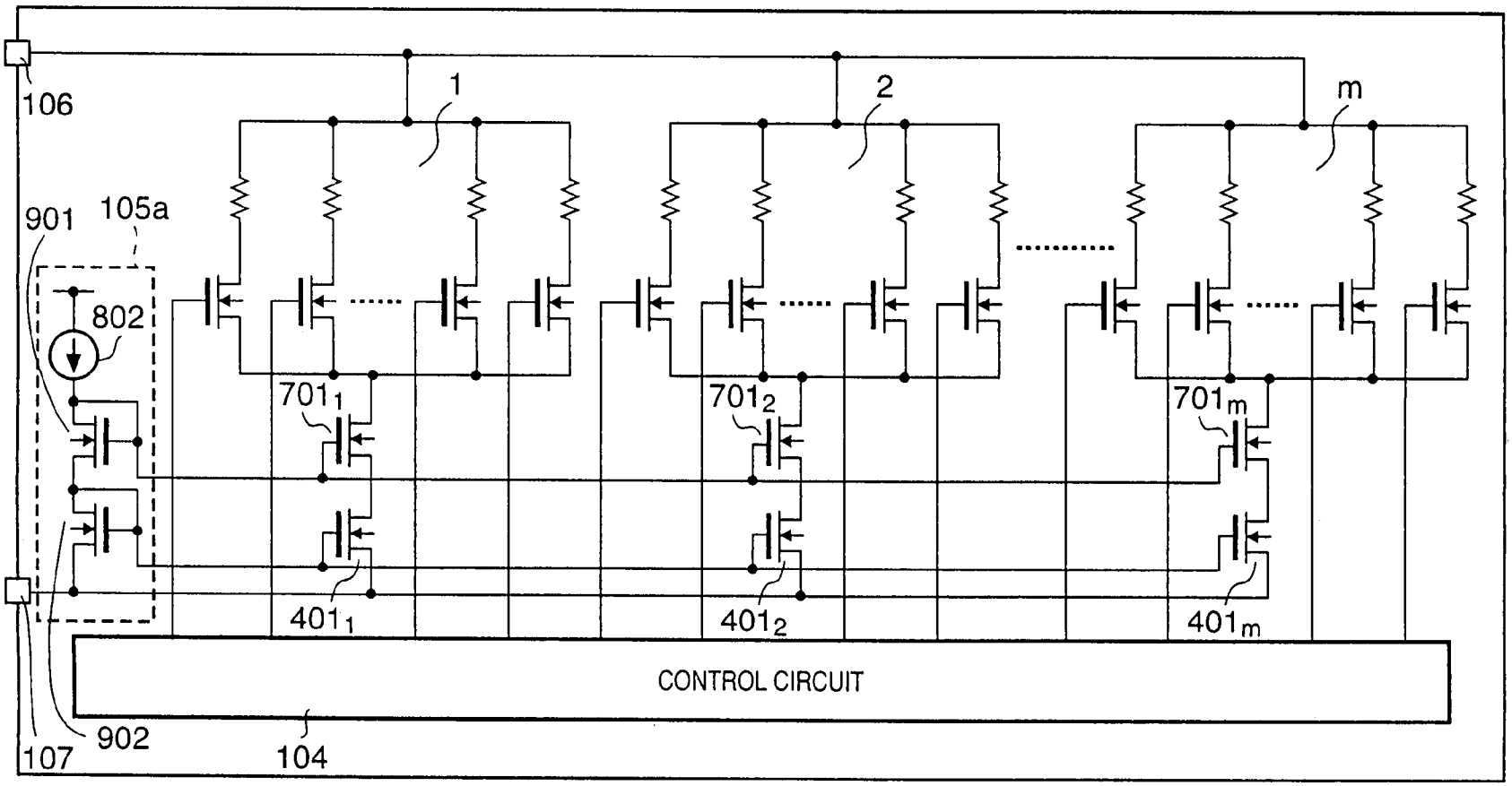
FIG. 9 is a circuit diagram showing an example of a heater driving circuit in a printhead according to the fifth embodiment of the present invention.

FIG. 9 is a block diagram showing the arrangement of a head driving circuit in a printhead according to the fifth embodiment of the present invention. The gates of NMOS transistors $\mathbf{701}_1$ to $\mathbf{701}_m$ in the driving circuit shown in FIG. 7 are connected to the gate of an NMOS transistor 901 of a reference current circuit 105*a*. The gate and drain of the NMOS transistor 901 are diode-connected, and the NMOS transistor 901 applies a constant voltage to the gates of the NMOS transistors $\mathbf{701}_1$ to $\mathbf{701}_m$.

With the arrangement of FIG. 9, the voltages between the gates and sources of the NMOS transistor 901 and NMOS transistors $\mathbf{701}_1$ to $\mathbf{701}_m$ become almost equal to each other, and thus the drain voltages of an NMOS transistor 902 and NMOS transistors $\mathbf{401}_1$ to $\mathbf{401}_m$ also become almost equal to each other. Since the gate voltages and drain voltages of the NMOS transistor 902 and NMOS transistors $\mathbf{401}_1$ to $\mathbf{401}_m$ become almost equal to each other, a reference current is mirrored at high precision in currents output from the NMOS transistors $\mathbf{401}_1$ to $\mathbf{401}_m$ regardless of the drain voltages of the NMOS transistors $\mathbf{701}_1$ to $\mathbf{701}_m$.

Sixth Embodiment

Figure 15:
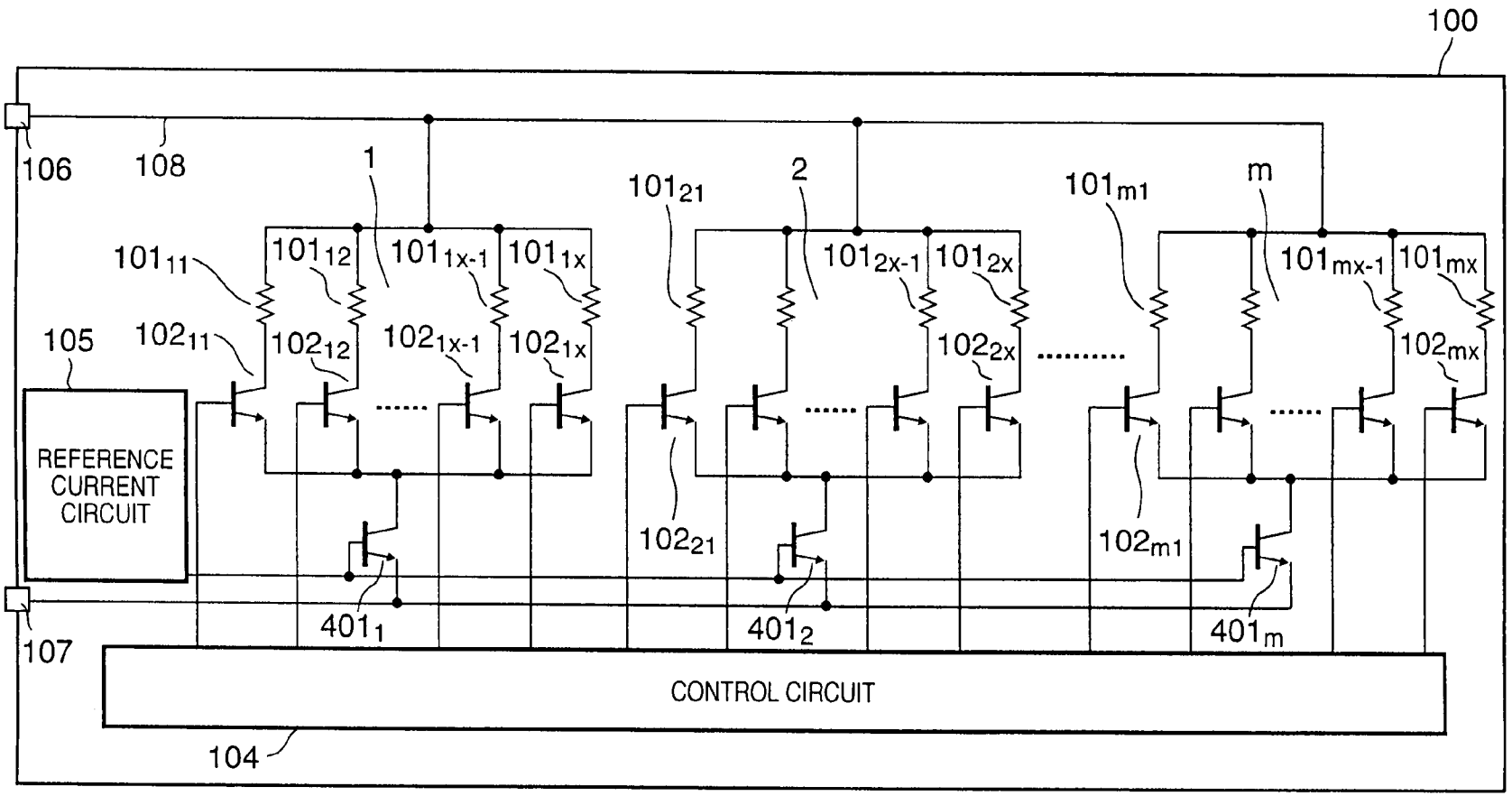
FIG. 15 is a circuit diagram showing an example of a heater driving circuit in a printhead according to the sixth embodiment of the present invention.

FIG. 15 is a circuit diagram showing an example using bipolar transistors in place of NMOS transistors in the embodiment shown in FIG. 4.

The bases of transistors $\mathbf{401}_1$ to $\mathbf{401}_m$ are connected to a reference current circuit 105, and used as control terminals to output constant currents from the collectors of the transistors, thereby driving heaters by the constant currents. In this way, the same operation as that of NMOS transistors can be achieved even by replacing them with bipolar transistors.

An NMOS transistor is employed for a constant current source circuit in the first to fifth embodiments, but a printing element can also be driven by a constant current using a bipolar transistor.

Figure 10:
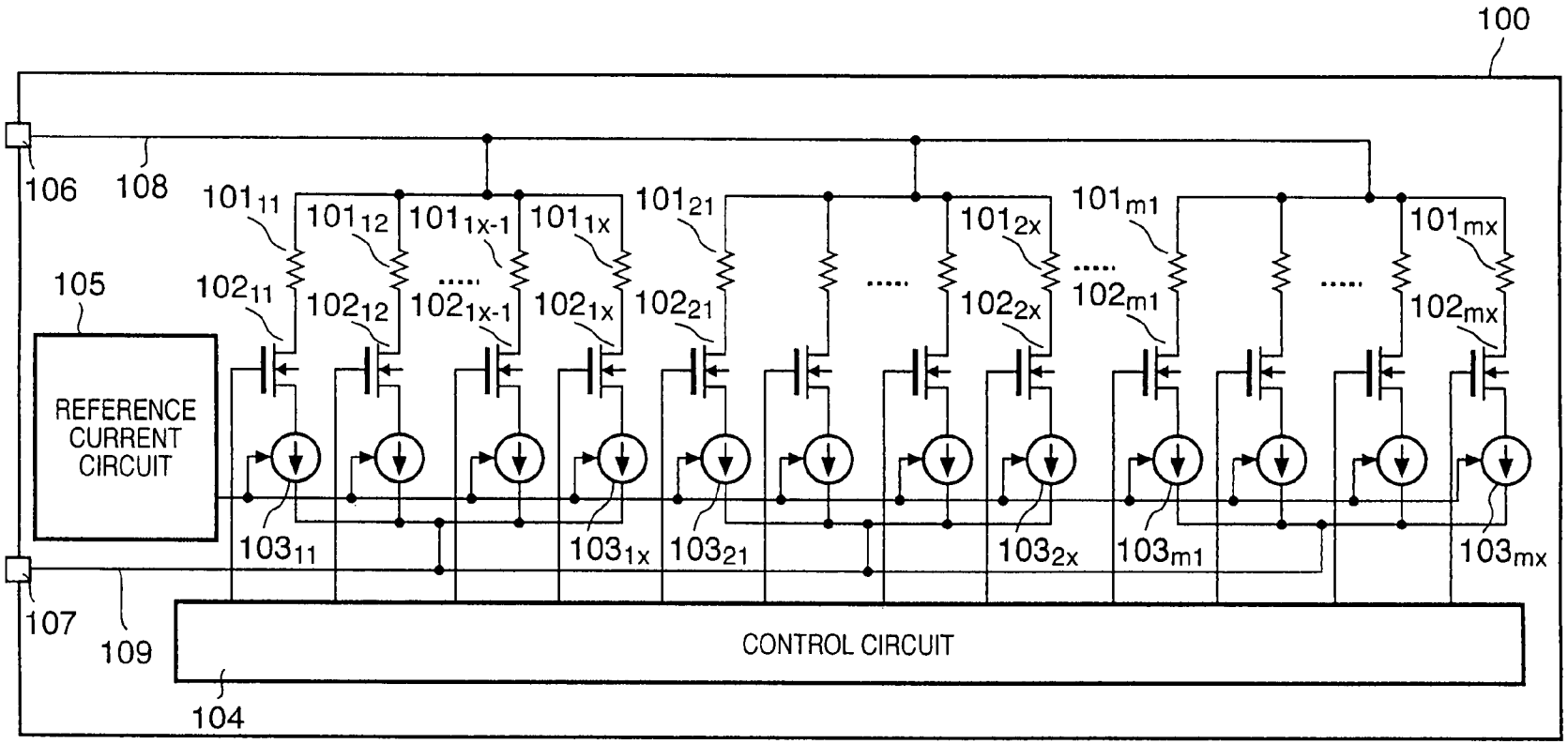
FIG. 10 is a circuit diagram showing an example of a heater driving circuit.
Figure 11:
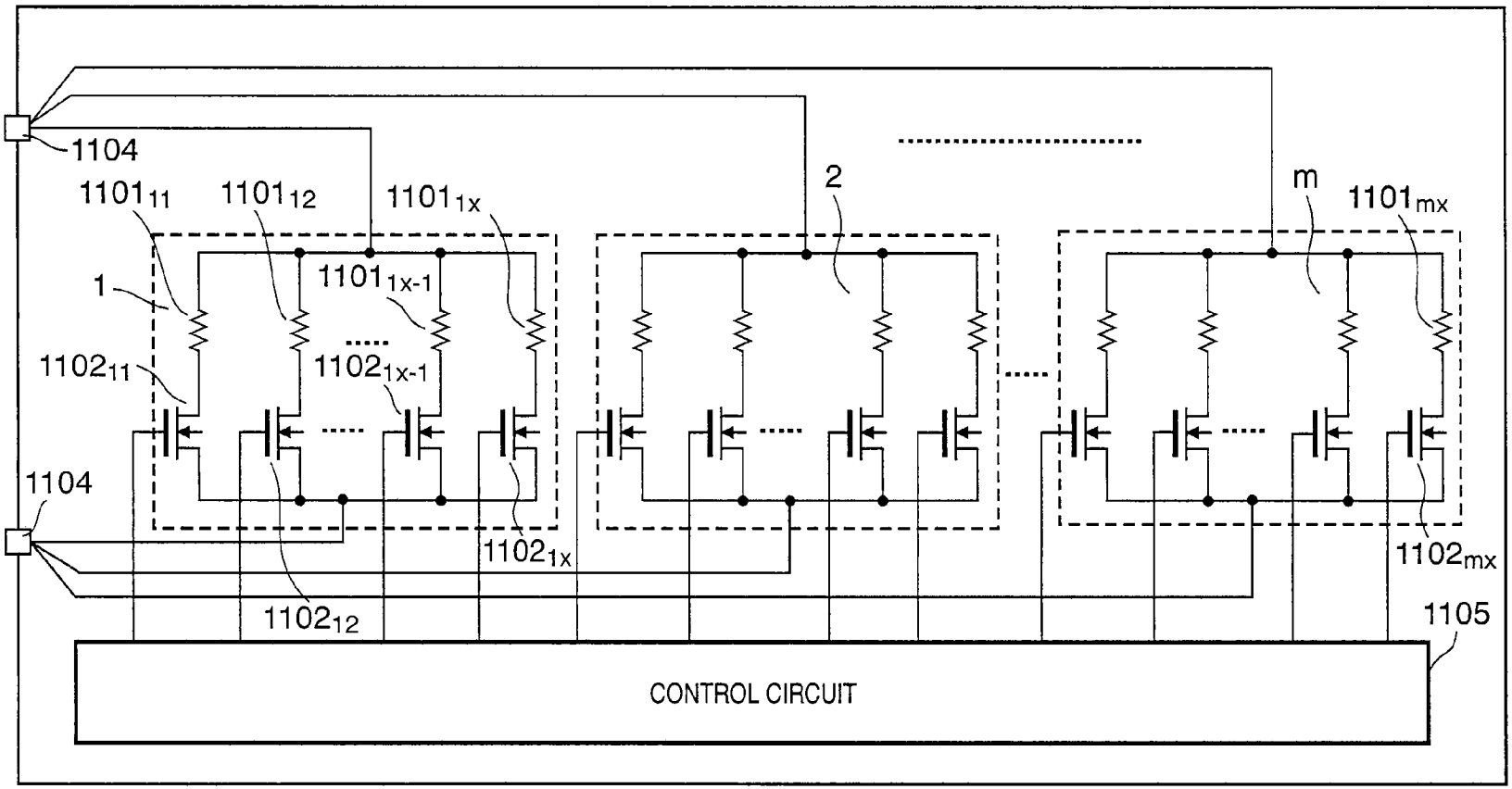
FIG. 11 PRIOR ART
FIG. 11 is a circuit diagram showing a conventional heater driving circuit.
Figure 12:
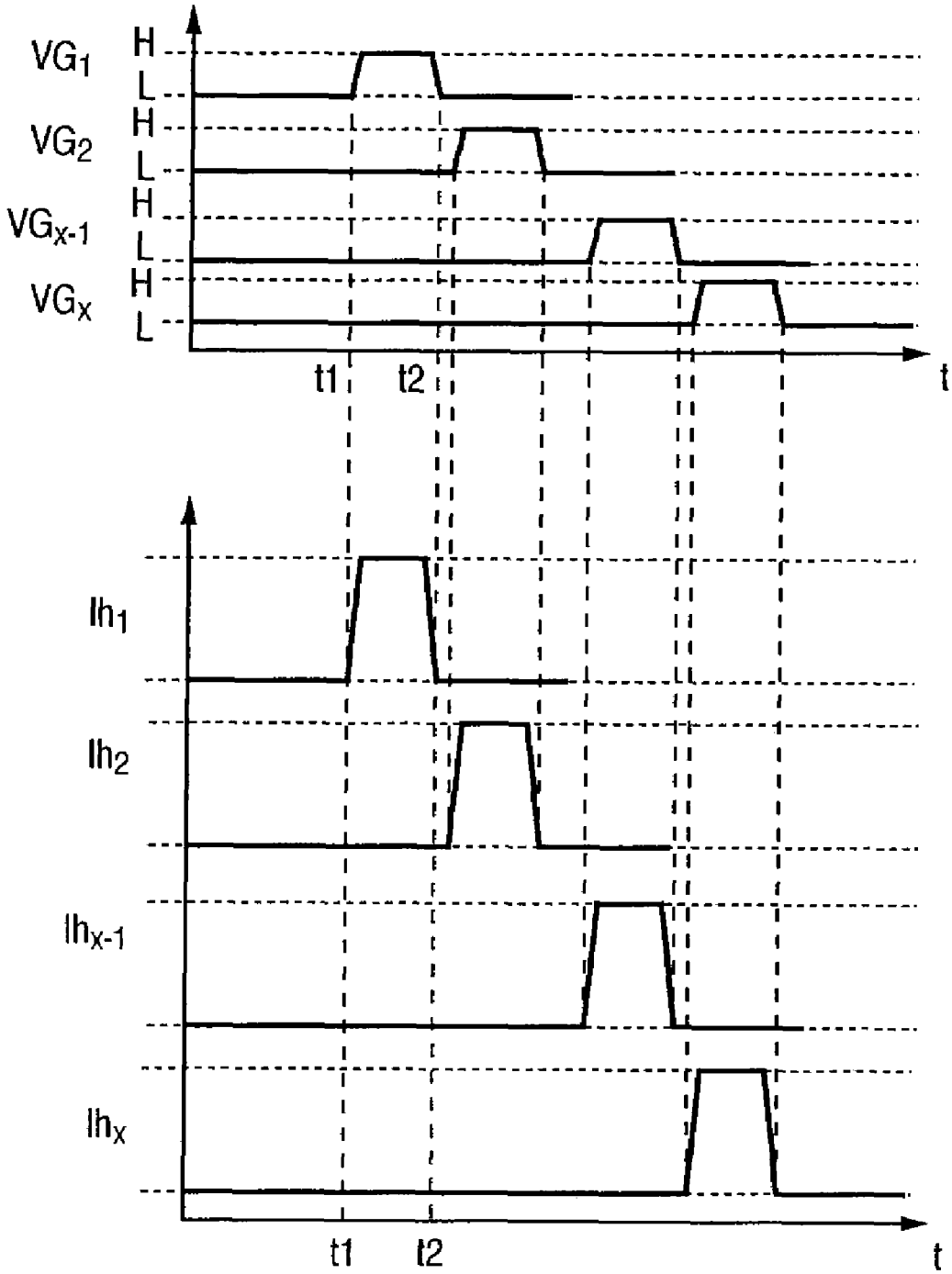
FIG. 12 PRIOR ART
FIG. 12 is a timing chart showing a signal which operates the conventional heater driving circuit.
Figure 13:
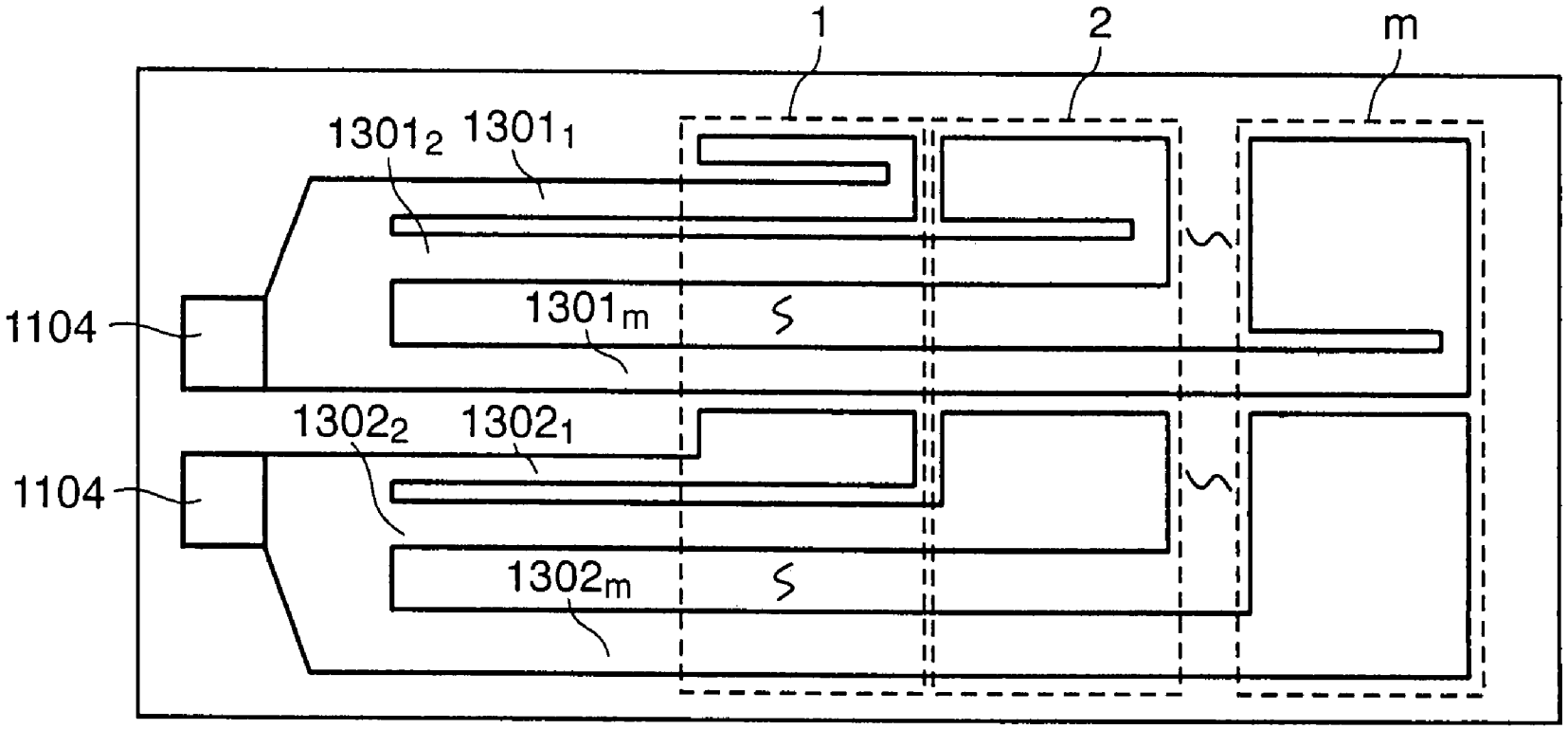
FIG. 13 depicts a view showing the wiring layout of a heater substrate.
Figure 14:
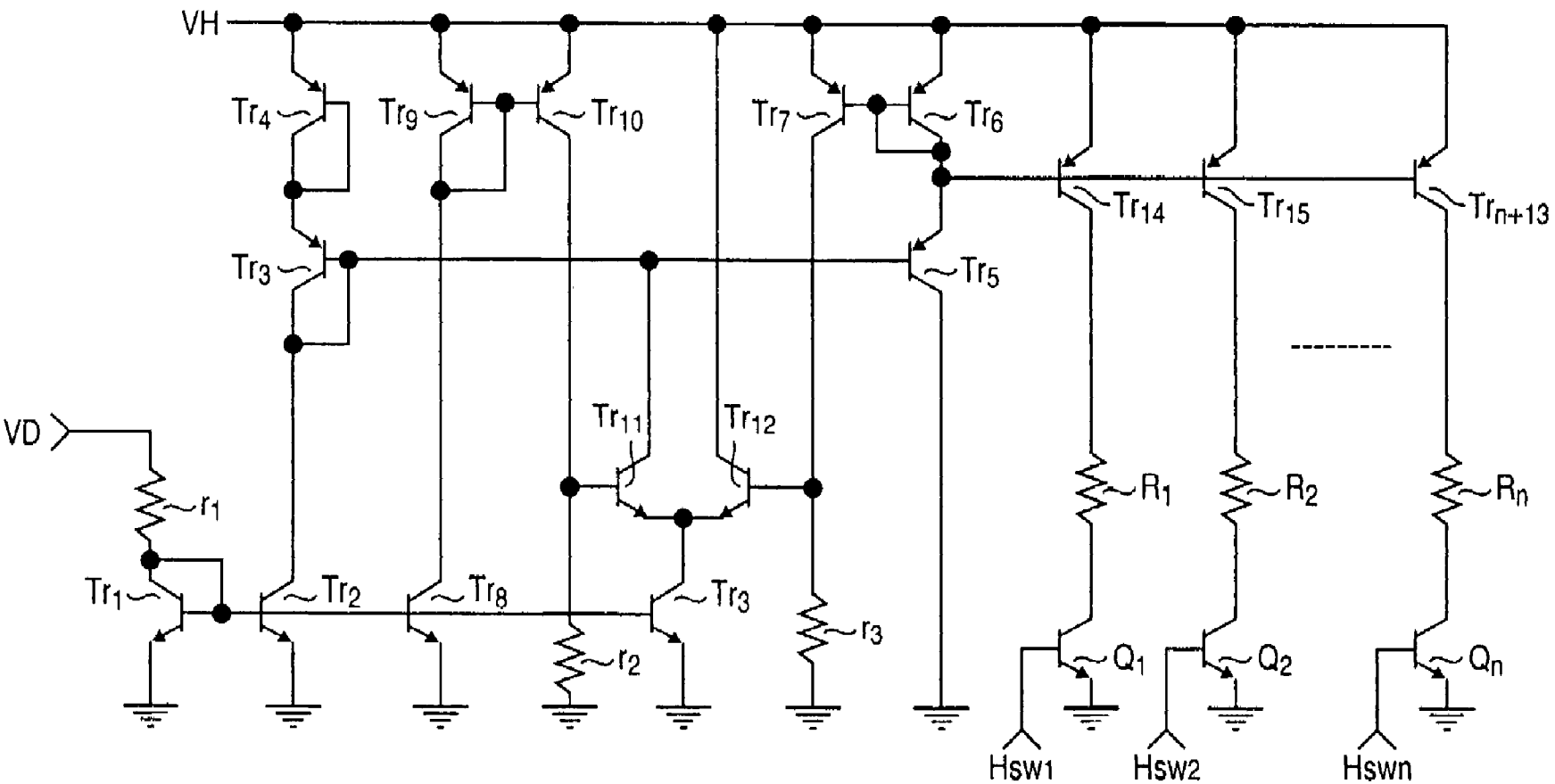
FIG. 14 is a circuit diagram showing the arrangement of another conventional heater driving circuit.

The number of constant current circuits can be decreased in comparison with the arrangement of FIG. 10 in which constant current sources $\mathbf{103}_{11}$ to $\mathbf{103}_{mx}$ are individually arranged for respective heaters. Consequently, the area of the heater substrate can be decreased, and the cost of one heater substrate can be reduced. In FIG. 10, the same reference numerals as those in FIG. 1 denote the same parts, and individual constant current sources ($\mathbf{103}_{11}$ to $\mathbf{103}_{mx}$) are connected to respective heaters. In the example of FIG. 10, current values to be supplied to the respective heaters can be controlled, but the number of constant current circuits increases, and this makes the design difficult in terms of downsizing of the circuit or the like.

To the contrary, the arrangement of FIG. 9 can suppress the number of constant current sources small, can suppress variations in the relative output currents of constant current sources, and can apply almost uniform energy to respective heaters. Hence, ink discharge becomes stable, and high-quality image printing can be implemented.

The circuit arrangement of FIG. 1, 4, 7, 8, 9, or 10 or the like according to the embodiments may be built in one element substrate. The reference current circuit may be arranged outside the element substrate, but is desirably built in the same element substrate.

An inkjet head having a heater substrate of the above-described arrangement, and an inkjet printing apparatus integrating the inkjet head will be exemplified.

Figure 16:
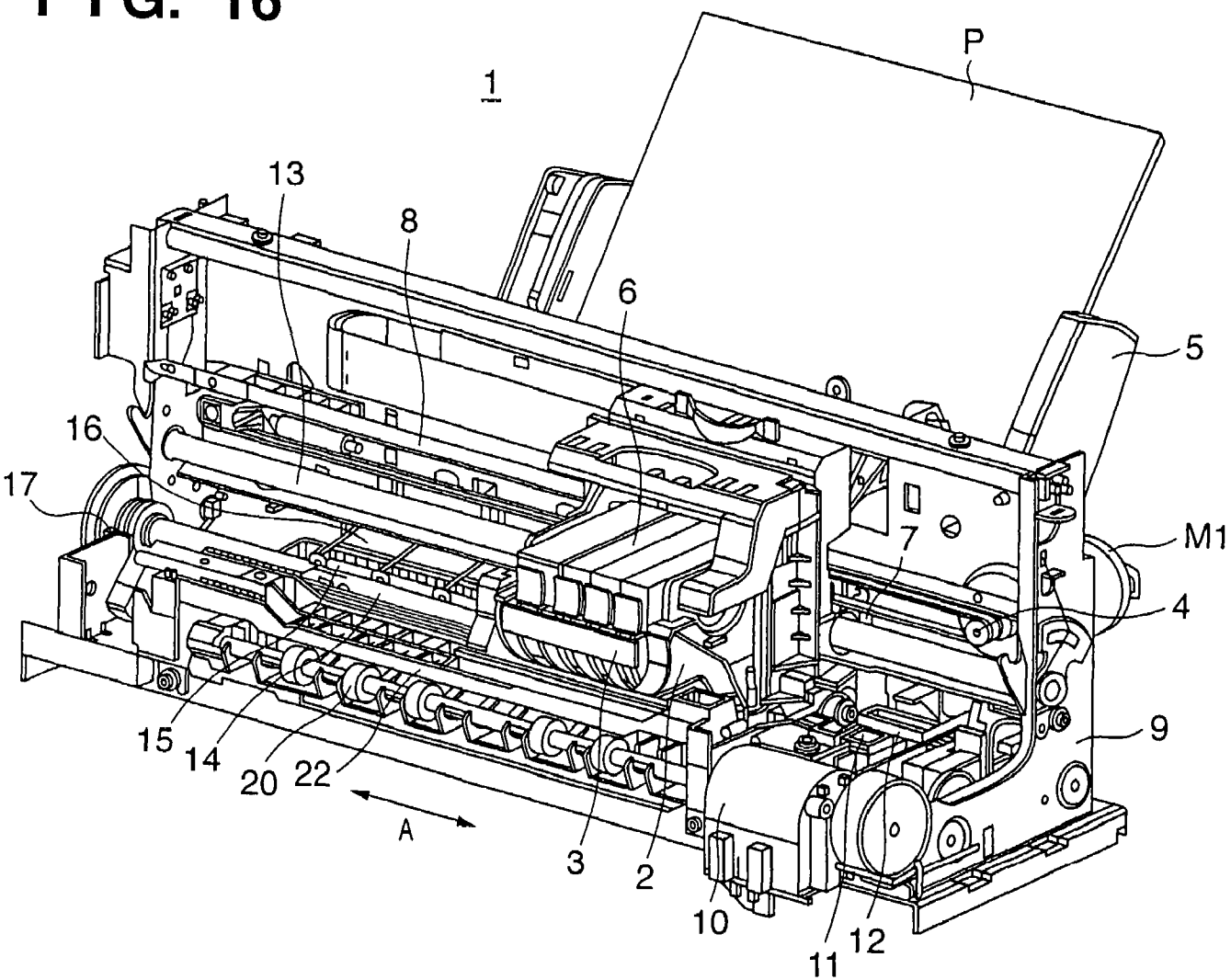
FIG. 16 depicts an outer perspective view showing the schematic arrangement of an inkjet printing apparatus according to the embodiment.

FIG. 16 is an outer perspective view showing the schematic arrangement of an inkjet printing apparatus 1 as a typical embodiment of the present invention.

As shown in FIG. 16, in the inkjet printing apparatus (to be referred to as a recording apparatus hereinafter), a transmission mechanism 4 transmits a driving force generated by a carriage motor M1 to a carriage 2 which supports a recording head 3 for discharging ink to record by the inkjet method, and the carriage 2 reciprocates in a direction indicated by an arrow A. A recording medium P such as a printing sheet is fed via a sheet feed mechanism 5, and conveyed to a recording position. At the recording position, the recording head 3 discharges ink to the recording medium P to record. In order to maintain a good state of the recording head 3, the carriage 2 is moved to the position of a recovery device 10, and a discharge recovery process for the recording head 3 is executed intermittently.

The carriage 2 of the recording apparatus 1 supports not only the recording head 3, but also an ink cartridge 6 which stores ink to be supplied to the recording head 3. The ink cartridge 6 is detachable from the carriage 2.

The recording apparatus 1 shown in FIG. 16 can record in color. For this purpose, the carriage 2 supports four ink cartridges which respectively store magenta (M), cyan (C), yellow (Y), and black (K) inks. The four ink cartridges are independently detachable.

The carriage 2 and recording head 3 can achieve and maintain a predetermined electrical connection by properly bringing their contact surfaces into contact with each other. The recording head 3 selectively discharges ink from a plurality of orifices and records by applying energy in accordance with the recording signal. In particular, the recording head 3 according to the embodiment adopts an inkjet method of discharging ink by using thermal energy, and comprises an electrothermal transducer in order to generate thermal energy. Electric energy applied to the electrothermal transducer is converted into thermal energy, and ink is discharged from orifices by utilizing a pressure change caused by the growth and contraction of bubbles by film boiling generated by applying the thermal energy to ink. The electrothermal transducer is arranged in correspondence with each orifice, and ink is discharged from a corresponding orifice by applying a pulse voltage to a corresponding electrothermal transducer in accordance with the recording signal.

As shown in FIG. 16, the carriage 2 is coupled to part of a driving belt 7 of the transmission mechanism 4 which transmits the driving force of the carriage motor M1. The carriage 2 is slidably guided and supported along a guide shaft 13 in the direction indicated by the arrow A. The carriage 2 reciprocates along the guide shaft 13 by normal rotation and reverse rotation of the carriage motor M1. A scale 8 which represents the absolute position of the carriage 2 is arranged along the moving direction (direction indicated by the arrow A) of the carriage 2. In the embodiment, the scale 8 is prepared by recording black bars on a transparent PET film at a necessary pitch. One end of the scale 8 is fixed to a chassis 9, and the other end is supported by a leaf spring (not shown).

The recording apparatus 1 has a platen (not shown) in opposition to the orifice surface having the orifices (not shown) of the recording head 3. Simultaneously when the carriage 2 supporting the recording head 3 reciprocates by the driving force of the carriage motor M1, a recording signal is supplied to the recording head 3 to discharge ink and record on the entire width of the recording medium P conveyed onto the platen.

In FIG. 16, reference numeral 14 denotes a conveyance roller which is driven by a conveyance motor M2 in order to convey the recording medium P; 15, a pinch roller which makes the recording medium P abut against the conveyance roller 14 by a spring (not shown); 16, a pinch roller holder which rotatably supports the pinch roller 15; and 17, a conveyance roller gear which is fixed to one end of the conveyance roller 14. The conveyance roller 14 is driven by rotation of the conveyance motor M2 that is transmitted to the conveyance roller gear 17 via an intermediate gear (not shown).

Reference numeral 20 denotes a discharge roller which discharges the recording medium (sheet) P bearing an image formed by the recording head 3 outside the recording apparatus. The discharge roller 20 is driven by transmitting rotation of the conveyance motor M2. The discharge roller 20 abuts against a spur roller (not shown) which presses the recording medium P by a spring (not shown). Reference numeral 22 denotes a spur holder which rotatably supports the spur roller.

In the recording apparatus 1, as shown in FIG. 16, the recovery device 10 which recovers the recording head 3 from a discharge failure is arranged at a desired position (e.g., a position corresponding to the home position) outside the reciprocation range (recording region) for recording operation of the carriage 2 supporting the recording head 3.

The recovery device 10 comprises a capping mechanism 11 which caps the orifice surface of the recording head 3, and a wiping mechanism 12 which cleans the orifice surface of the recording head 3. The recovery device 10 performs a discharge recovery process in which a suction means (suction pump or the like) within the recovery device forcibly discharges ink from orifices in synchronism with capping of the orifice surface by the capping mechanism 11, thereby removing ink with a high viscosity or bubbles in the ink passage of the recording head 3.

In non-recording operation or the like, the orifice surface of the recording head 3 is capped by the capping mechanism 11 to protect the recording head 3 and prevent evaporation and drying of ink. The wiping mechanism 12 is arranged near the capping mechanism 11, and wipes ink droplets attached to the orifice surface of the recording head 3.

The capping mechanism 11 and wiping mechanism 12 can maintain a normal ink discharge state of the recording head 3.

<Control Configuration of Inkjet Printing Apparatus (FIG. 17)>

Figure 17:
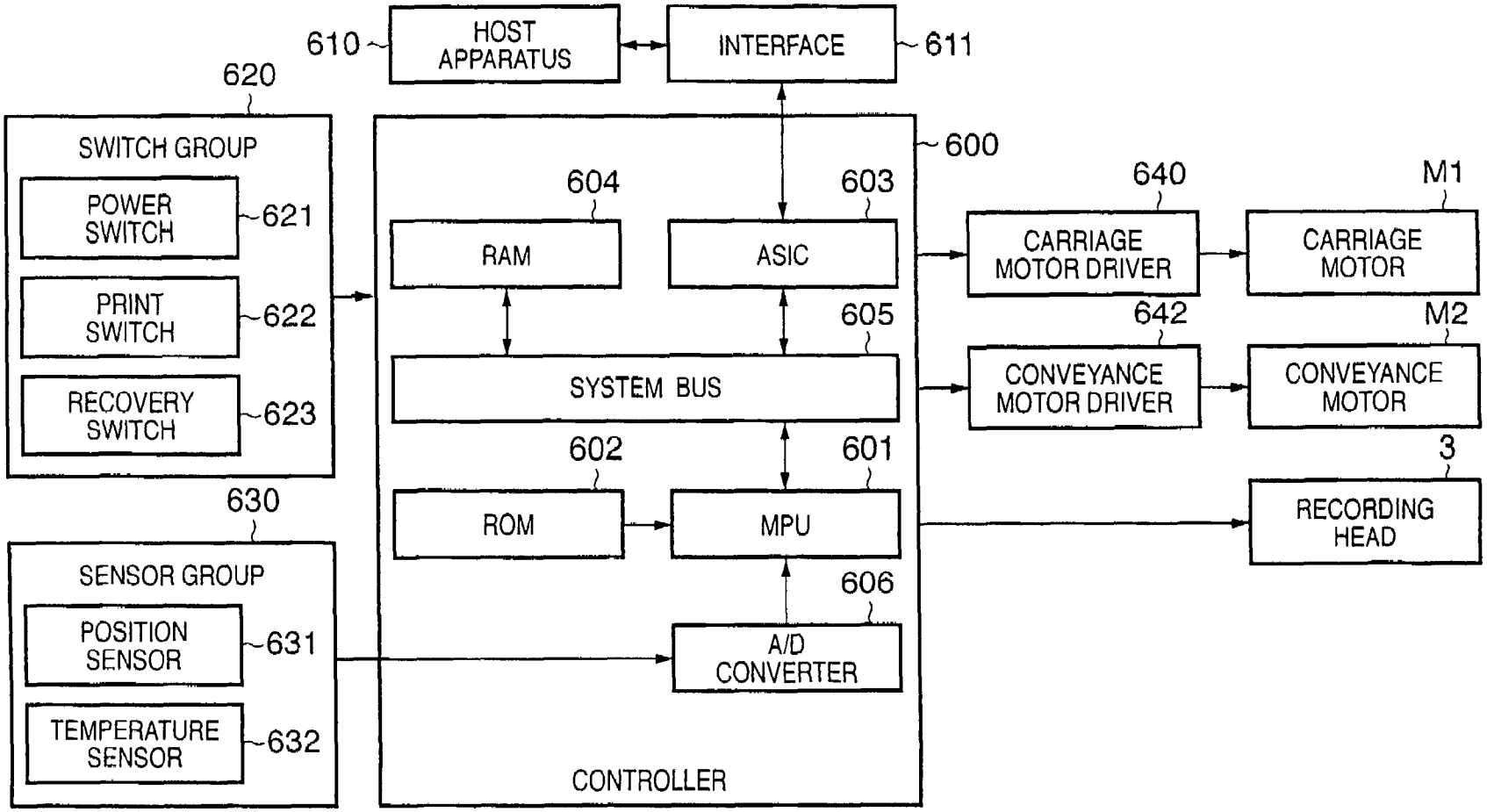
FIG. 17 is a block diagram showing the functional configuration of the inkjet printing apparatus according to the embodiment.

FIG. 17 is a block diagram showing the control configuration of the recording apparatus shown in FIG. 16.

As shown in FIG. 17, a controller 600 comprises an MPU 601, a ROM 602 which stores a program corresponding to a control sequence (to be described later), a predetermined table, and other fixed data, an application specific IC (ASIC) 603 which generates control signals for controlling the carriage motor M1, conveyance motor M2, and recording head 3, a RAM 604 having an image data rasterizing area, a work area for executing a program, and the like, a system bus 605 which connects the MPU 601, ASIC 603, and RAM 604 to each other and exchanges data, and an A/D converter 606 which receives analog signals from a sensor group (to be described below), A/D-converts them, and supplies digital signals to the MPU 601.

In FIG. 17, reference numeral 610 denotes a host apparatus such as a computer (or an image reader, digital camera, or the like) serving as an image data supply source. The host apparatus 610 and recording apparatus 1 transmit/receive image data, commands, status signals, and the like via an interface (I/F) 611.

Reference numeral 620 denotes a switch group which is formed from switches for receiving instruction inputs from the operator, such as a power switch 621, a print switch 622 for designating the start of recording, and a recovery switch 623 for designating the activation of a process (recovery process) of maintaining good ink discharge performance of the recording head 3. Reference numeral 630 denotes a sensor group which detects the state of the apparatus and includes a position sensor 631 such as a photocoupler for detecting a home position h and a temperature sensor 632 arranged at a proper portion of the recording apparatus in order to detect the ambient temperature.

Reference numeral 640 denotes a carriage motor driver which drives the carriage motor M1 for reciprocating the carriage 2 in the direction indicated by the arrow A; and 642, a conveyance motor driver which drives the conveyance motor M2 for conveying the recording medium P.

In recording and scanning by the recording head 3, the ASIC 603 transfers driving data (DATA) for a recording element (discharge heater) to the recording head while directly accessing the storage area of the ROM 602.

Figure 18:
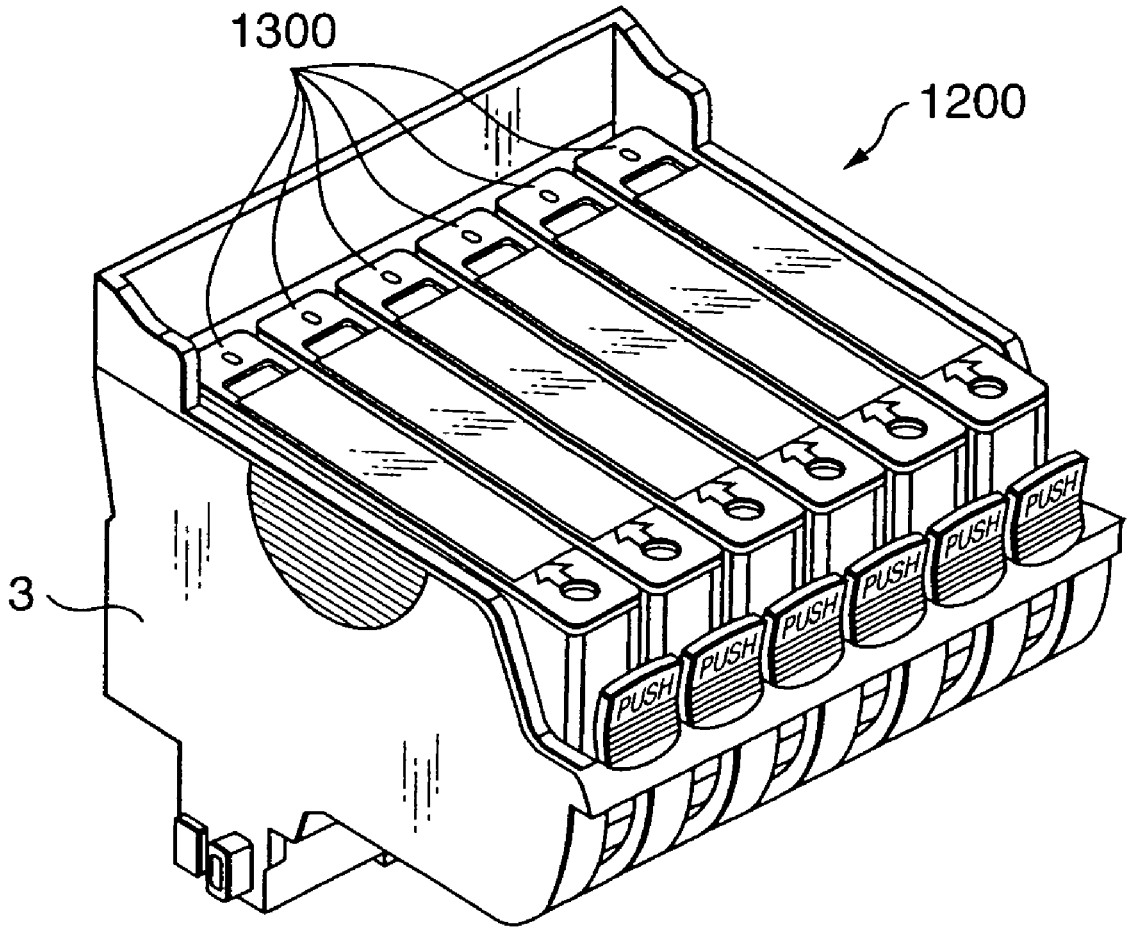
FIG. 18 depicts a schematic perspective view showing the structure of a printhead according to the embodiment.

FIG. 18 is a schematic perspective view showing the structure of a recording head cartridge including the recording head according to the embodiment.

As shown in FIG. 18, a recording head cartridge 1200 in the embodiment comprises ink tanks 1300 which store ink, and the recording head 3 which discharges ink supplied from the ink tanks 1300 from nozzles in accordance with recording information. The recording head 3 is a so-called cartridge type recording head which is detachably mounted on the carriage 2. In recording, the recording head cartridge 1200 reciprocally scans along the carriage shaft, and a color image is recorded on the printing sheet along with this scanning. In order to implement high-quality photographic color recording, the recording head cartridge 1200 shown in FIG. 18 is equipped with independent ink tanks for, e.g., black, light cyan (LC), light magenta (LM), cyan, magenta, and yellow, and each ink tank is freely detachable from the recording head 3.

In FIG. 18, the six color inks are used. Alternatively, recording may be done with inks of four, black, cyan, magenta, and yellow colors, as shown in FIG. 16. In this case, independent ink tanks for the four colors may be detachable from the recording head 3.

The present invention may be applied to a system including a plurality of devices (e.g., a host computer, interface device, reader, and printer) or an apparatus (e.g., a copying machine or facsimile apparatus) formed by a single device.

The embodiments have described an inkjet printhead, but the present invention is not limited to this and can also be applied to a thermal head or the like.

The embodiments have described a circuit example using an NMOS transistor, but the present invention is not limited to this and can be similarly implemented even with a PMOS transistor.

The recording head cartridge 1200 is configured so that the ink tank 1300 is detachable from the recording head, but a head cartridge integrated with a recording head may be applied.

As has been described above, the recording head according to the embodiments comprises a constant current source circuit which is common to a plurality of heaters and controls to supply a constant current to the heaters, and a switching circuit which controls the current supply time. The recording head can apply uniform electric energy to the heaters.

The breakdown voltage of the MOS transistor of the switching circuit is desirably set higher than that of the MOS transistor of the constant current source circuit.

The present invention is not limited to the above embodiments, and various changes and modifications can be made. The technical range of the present invention is defined by the appended claims.

The invention claimed is:

1. An inkjet recording head having a plurality of heaters configured to eject ink, a control circuit configured to supply print signals to time-divisionally drive respective heaters in accordance with an image signal, and a plurality of switching circuits, connected in series to the respective heaters, configured to control energization of the corresponding heaters in accordance with the print signals supplied from the control circuit, the ink jet recording head comprising:

a plurality of constant current sources, each being connected to one of plural groups of the heaters and the switching circuits in series, configured to supply a constant current to a heater belonging to a group, wherein in each group, plural sets of heaters and switching circuits connected in series to the respective heaters are connected in parallel, and a plurality of groups and the constant current sources connected to the respective groups are connected in parallel to a pair of power supply lines from an external power supply; and a current control circuit configured to control the constant currents supplied from said constant current sources, wherein each of the plurality of switching circuits has a MOS transistor to energize a corresponding heater in a group during the print signal being supplied from the control circuit, and each of said plurality of constant current sources includes a MOS transistor to supply the constant current that is adjusted by said current control circuit to the corresponding heater belonging to the group to which each of said plurality of constant current sources is connected.

2. The inkjet recording head according to claim 1, wherein said current control circuit controls a gate potential of the MOS transistor of each of said plurality of constant current sources.

3. The inkjet recording head according to claim 2, wherein said current control circuit controls a gate voltage of the MOS transistor of each of said constant current sources so as to operate the MOS transistor of each of said constant current sources in a saturation region where a drain current hardly changes upon a change in a drain voltage.

4. The inkjet recording head according to claim 2, wherein said current control circuit has a constant current circuit and a MOS transistor, and an output of the constant current circuit is connected to a gate of the MOS transistor of said current control circuit and a gate of the MOS transistor of each of said constant current sources.

5. The ink jet recording head according to claim 4, wherein said current control circuit and the constant current circuit form a current mirror circuit.

6. The inkjet recording head according to claim 2, wherein each of said constant current sources includes a MOS transistor series-connected to a drain of the MOS transistor.

7. The inkjet recording head according to claim 2, wherein a breakdown voltage of a MOS transistor of each of said switching circuits is higher than a breakdown voltage of the MOS transistor of each of said constant current sources.

8. The inkjet recording head according to claim 2, wherein both said plurality of switching circuits and said constant current sources include MOS transistors, and said constant current sources output the constant currents by controlling ON resistances of the MOS transistors.

9. The inkjet recording head according to claim 1, wherein the plurality of heaters, the plurality of switching circuits, said constant current sources, the control circuit and said current control circuits are built in the same element substrate.

10. The inkjet recording head according to claim 1, further comprising first and second power supply lines for supplying electric power to the heaters, wherein the heaters are connected to the first power supply line and the constant current sources are connected to the second power supply line.

11. An inkjet recording head according to claim 1, wherein the plurality of constant current circuits are arranged in correspondence with the plurality of groups and commonly connected to said current control circuit.

12. An inkjet recording apparatus having an inkjet recording head including a plurality of heaters configured to eject ink, a control circuit configured to supply print signals to time-divisionally drive respective heaters in accordance with an image signal, and a plurality of switching circuits, connected in series to the respective heaters, configured to control energization of the corresponding heaters in accordance with the print signals supplied from the control circuit, and a carriage for mounting the inkjet recording head, the apparatus comprising:

conveyance means for relatively moving the carriage and a recording medium; and driving control means for driving the inkjet recording head to supply the image signal to the inkjet recording head in synchronism with relative movement by said conveyance means, and forming an image on the recording medium, the inkjet recording head comprising:

a plurality of constant current sources, each being connected to one of plural groups of the heaters and the switching circuits in series, configured to supply a constant current to a heater belonging to a group, wherein in each group, plural sets of heaters and switching circuits connected in series to the respective heaters are connected in parallel, and a plurality of the groups and the constant current sources connected to the respective groups are connected in parallel to a pair of power supply lines from an external power supply, and a current control circuit configured to control the constant currents supplied from the constant current sources, wherein each of the plurality of switching circuits has a MOS transistor to energize a corresponding heater in a group during the print signal being supplied from said driving control means, and each of said plurality of constant current sources includes a MOS transistor to supply the constant current that is adjusted by said current control circuit to the corresponding heater belonging to the group to which each of said plurality of constant current sources is connected.

13. The inkjet recording apparatus according to claim 12, wherein the current control circuit controls a gate voltage of a MOS transistor of each of the constant current sources so as to operate the MOS transistor of each of the constant current sources in a saturation region where a drain current hardly changes upon a change in a drain voltage.

14. The inkjet recording apparatus according to claim 12, wherein the current control circuit has a constant current circuit and a MOS transistor, an output of the constant current circuit is connected to a gate of the MOS transistor of the current control circuit and a gate of a MOS transistor of each of the constant current sources, and the current control circuit and the constant current circuit form a current mirror circuit.

15. A substrate of an inkjet recording head having a plurality of heaters configured to eject ink, a control circuit configured to supply print signals to time-divisionally drive respective heaters in accordance with an image signal, and a plurality of switching circuits, connected in series to the respective heaters, configured to control energization of the corresponding heaters in accordance with the print signals supplied from the control circuit, the substrate comprising:

a plurality of constant current sources, each being connected to one of plural groups of the heaters and the switching circuits in series, configured to supply a constant current to a heater belonging to a group, wherein in each group, plural sets of heaters and switching circuits connected in series to the respective heaters are connected in parallel, and a plurality of groups and the constant current sources connected to the respective groups are connected in parallel to a pair of power supply lines from an external power supply; and a current control circuit configured to control the constant currents supplied from said constant current sources, wherein each of the plurality of switching circuits has a MOS transistor to energize a corresponding heater in a group during the print signal being supplied from the control circuit, and each of said plurality of constant current sources includes a MOS transistor to supply the constant current that is adjusted by said current control circuit to the corresponding heater belonging to the group to which each of said plurality of constant current sources is connected.

16. The substrate according to claim 15, further comprising first and second power supply lines for supplying electric power to the heaters, wherein the heaters are connected to the first power supply line and the constant current sources are connected to the second power supply line.

17. The substrate according to claim 15, wherein each of said constant current sources includes a MOS transistor and said current control circuit controls a gate voltage of each MOS transistor.

18. The substrate according to claim 17, wherein said current control circuit controls a gate voltage of the MOS transistor of each of said constant current sources so that the MOS transistor of each of the constant current sources operates in a saturation region in which a drain current hardly changes upon a change of drain voltage.

19. The substrate according to claim 17, wherein a breakdown voltage of a MOS transistor of each of said switching circuits is higher than a breakdown voltage of the MOS transistor of each of said constant current sources.

20. The substrate according to claim 17, wherein both said plurality of switching circuits and said constant current sources include MOS transistors, and each of said constant current sources outputs the constant current by controlling ON resistance of the MOS transistor.

* * * * *